US007455385B2

(12) United States Patent
Takeda

(10) Patent No.: US 7,455,385 B2
(45) Date of Patent: Nov. 25, 2008

(54) HEAD CAPPING DEVICE AND LIQUID EJECTING APPARATUS INCORPORATING THE SAME

(75) Inventor: Katsuhiro Takeda, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 426 days.

(21) Appl. No.: 11/391,401

(22) Filed: Mar. 29, 2006

(65) Prior Publication Data

US 2006/0232625 A1 Oct. 19, 2006

(30) Foreign Application Priority Data

| | | |
|---|---|---|
| Mar. 29, 2005 | (JP) | 2005-095939 |
| Mar. 29, 2005 | (JP) | 2005-095952 |
| Mar. 29, 2005 | (JP) | 2005-095988 |
| Feb. 15, 2006 | (JP) | 2006-038150 |
| Feb. 15, 2006 | (JP) | 2006-038167 |

(51) Int. Cl.
*B41J 2/165* (2006.01)

(52) U.S. Cl. ..... 347/29

(58) Field of Classification Search ..... 347/22, 347/29, 32

See application file for complete search history.

(56) References Cited

U.S. PATENT DOCUMENTS 5,260,724 A * 11/1993 Tomii et al. ..... 347/32
6,286,930 B1 9/2001 Kobayashi et al.
2003/0020779 A1 1/2003 Takahashi

FOREIGN PATENT DOCUMENTS

| | | |
|---|---|---|
| EP | 1 674 267 A2 | 6/2006 |
| JP | 2002-307701 A | 10/2002 |
| WO | WO 2006/001535 A1 | 1/2006 |

* cited by examiner

*Primary Examiner*—An H Do
(74) *Attorney, Agent, or Firm*—Sughrue Mion, PLLC

(57) ABSTRACT

A head capping device is adapted to seal a nozzle formation face of a liquid ejecting head in which a nozzle orifice from which liquid is ejected is formed. A capping unit includes: a cap, adapted to be abutted against the nozzle formation face to seal the nozzle orifice; a regulator, provided on the cap; a slider, mounting the cap; and a claw, provided on the slider and adapted to be abutted against the liquid ejecting head. An actuator is operable to move the capping unit in between a first position at which the cap is separated away from the nozzle formation face and a second position at which the cap is abutted against the nozzle formation face. The slider is so configured as to have a first movable length during the movement between the first position and the second position. The cap is so configured as to have a second movable length which is smaller than the first movable length, during the movement between the first position and the second position. The regulator is so configured as to be abutted against a base to restrict the movement of the cap in a direction separating away from the liquid ejecting head when the capping unit is moved from the second position to the first position.

6 Claims, 25 Drawing Sheets

106
202
203
204
205
207
210
215
215a
d

HEAD CAPPING DEVICE AND LIQUID EJECTING APPARATUS INCORPORATING THE SAME

BACKGROUND OF THE INVENTION

The present invention relates to a head capping device that includes a capping unit which can move to a first position, which is spaced apart from a recording head, and a second position, which comes into contact with the recording head to seal a nozzle orifice array composed of nozzle orifices, by an actuator.

The present invention relates to a liquid ejecting apparatus incorporating such a head capping device.

A liquid ejecting apparatus is not limited to recording apparatuses, such as an ink jet recording apparatus a copy machine, a facsimile or the like, in which ink is ejected onto a recording medium, such as recording paper, from a recording head serving as a liquid ejecting head, so that recording is performed on the recording medium. Examples of the liquid ejecting apparatus include various apparatuses in which, instead of the ink, liquid for a specific purpose is ejected onto a target medium from a liquid ejecting head, so that the ejected liquid adheres onto the target medium. In addition, examples of the liquid ejecting head include the above-mentioned recording head, a colored material ejecting head that is used for manufacturing a color filter in a liquid crystal display or the like, an electrode material (conductive paste) ejecting head that is used for forming an electrode in an organic EL display or a field emission display (FED), a bioorganic material ejecting head that is used for manufacturing a biochip, a sample ejecting head that serves as a micropipette and ejects the sample, or the like.

As an example of the ink jet recording apparatus or the liquid ejecting apparatus, there is an ink jet printer. The ink jet printer comprises a carriage that mounts an ink jet recording head, and the carriage is reciprocally driven in a primary scanning direction by a carriage motor while being guided by a guide member (for example, a guiding shaft) that extends in the primary scanning direction.

Here, if the recording head continuously performs the recording on the recording medium, clogging or the like may occur in a nozzle orifice from which the ink is ejected, so that superior recording cannot be performed.

Accordingly, in order to maintain a state of the nozzle orifice as a superior state, the recording head performs the so-called flushing operation in which it moves to a head capping device during recording so as to eject the ink toward a cap. Then, after the recording is completed, the recording head moves to the head capping device so that the nozzle orifice is sealed with the cap. Then, the so-called suction operation is performed in which a pressure of the cap is turned into a negative pressure by a pump, so that the nozzle orifice is sucked.

When the flushing operation or the suction operation is performed, in order to determine the relative positional relationship between the recording head and the cap, a claw that can come into contact with the recording head is provided in the cap. Japanese Patent Publication No. 2002-307701A discloses such a head capping device in which a cap holder is provided with a claw and moves integrally with a cap.

Here, since the claw and the cap move together, when the flushing operation is performed, the distance between the cap and the recording head is increased, which results in occurrence of the mist.

Accordingly, it is suggested a head capping device in which a claw comes into contact with one side face of the recording head in a primary scanning direction to decrease the distance between the cap and the recording head at the time of flushing operation, thereby preventing the mist from occurring.

As shown in FIG. 18, a recording head 401 formed with nozzle orifices is mounted on a carriage. A claw 403 that can come into contact with the recording head 401 is formed in a capping unit 402.

When the flushing operation and the suction operation are performed, the carriage moves at a high speed in a direction shown by an arrow, and reduces a moving speed near a position opposing the capping unit 402. The recording head 401, which moves at a low speed, comes slowly into contact with the claw 403 of the capping unit 402 at the position shown in FIG. 18, so that the shock due to the contact can be decreased. When the recording head comes into contact with the claw 403, the recording head 401 pushes down the claw 403 by the driving of the carriage motor, and the urging force with respect to the carriage side is applied to the capping unit 402 by a spring (not shown). Accordingly, since the recording head 401 and the claw 403 come into contact with each other without clearance, the relative positional relationship between the recording head 401 and the capping unit 402 are determined with high precision. Then, the driving of the carriage motor is stopped. In this state, the ink is ejected from the nozzle orifice, that is, the flushing operation is performed.

In addition, the waiting position of the capping unit 402 is set to the distance from the recording head 401 to the extent that the mist can be prevented from occurring, and the distance to the extent that the cap does not come into contact with the recording head 401 when the carriage moves. Therefore, when the flushing operation is performed, the cap does not need to move.

Here, when the suction operation is performed, after the driving of the carriage motor is stopped, the capping unit 402 moves to and then comes into contact with the recording head so as to seal the nozzle orifice. Then, the pressure of inside of the carriage is turned into the negative pressure by the pump, and the nozzle orifice is sucked.

However, in order to prevent that the recording head abuts against the claw, since the recording head reduces the moving speed near the position opposing the cap so as to move at a low speed, the throughput may be decreased.

Further, when the recording head comes into contact with the claw to be placed in a predetermined position, the load applied to the carriage motor includes not only the moving load for the carriage but also the urging force of the cap. Therefore, the load for the carriage motor is increased, which results in making it difficult to reduce the size of the carriage motor.

In addition, when the cap is released from the state which seals the nozzle orifice, the cap and the recording head may adhere to each other due to the pushing force or the ink. Incidentally, the load for the adhesion releasing force and the load for the frictional resistance force between the claw and the recording head are simultaneously applied to an actuator for moving the cap, which results into making it difficult to reduce the size of the actuator.

SUMMARY OF THE INVENTION

It Is therefore an object of the invention to provide a head capping device which is capable of preventing the mist from occurring at the time of flushing operation, not reducing the speed when a carriage having a recording head moves to a position opposing a cap, and setting the relative positional relationship between the cap and the recording head with high precision when a nozzle orifice is sealed.

It is also an object of the invention to provide a head capping device capable of resolving a problem of the load generated when a cap is spaced apart from a recording head.

It is also an object of the invention to provide a liquid ejecting apparatus incorporating such a head capping device.

In order to achieve at least one of the above objects, according to the invention, there is provided a head capping device, adapted to seal a nozzle formation face of a liquid ejecting head in which a nozzle orifice from which liquid is ejected is formed, the device comprising:

a base;

a capping unit, comprising:

a cap, adapted to be abutted against the nozzle formation face to seal the nozzle orifice;

a regulator, provided on the cap;

a slider, mounting the cap; and a claw, provided on the slider and adapted to be abutted against the liquid ejecting head; and an actuator, operable to move the capping unit in between a first position at which the cap is separated away from the nozzle formation face and a second position at which the cap is abutted against the nozzle formation face, wherein:

the slider is so configured as to have a first movable length during the movement between the first position and the second position;

the cap is so configured as to have a second movable length which is smaller than the first movable length, during the movement between the first position and the second position; and the regulator is so configured as to be abutted against the base to restrict the movement of the cap in a direction separating away from the liquid ejecting head when the capping unit is moved from the second position to the first position.

With the above configuration, at the first position, the position of the cap in the direction connecting the first position and the second position can be determined with high precision with respect to the base. That is, when the flushing operation is performed, the distance between the cap and the liquid ejecting head can be set with high precision. As a result, at the first position, the distance between the cap and the liquid ejecting head can be smaller to the extent that the mist does not occur, but can be set such that the liquid ejecting head and the cap do not come into contact with each other.

In addition, since the slider and the cap can independently move by the distance as required. For example, even though the slider is sufficiently separated away from the liquid ejecting head when the capping unit is placed in the first position, the cap can be configured to be placed in the vicinity of the liquid ejecting head. That is, when the flushing operation is performed, the cap can be placed such that it is possible to prevent the liquid ejected from the nozzle orifice from being floating mist. Therefore, an additional movement for preventing the mist is not required.

Furthermore, the slider can be configured that the claw is always separated apart from the liquid ejecting head when the capping unit is placed in the first position. In this case, the liquid ejecting head will not collide with the claw when the liquid ejecting head is moved to a position opposing the cap. Accordingly, the driving speed of the carriage motor does not need to be reduced near the position opposing the cap. As a result, the time taken for the flushing operation performed during the liquid ejection can be shortened. In addition, also when the suction operation is performed after the liquid ejection, the same advantage can be obtained.

Further, since the liquid ejecting head does not come into contact with the claw, when the liquid ejecting head moves to the position opposing the cap, the load applied on the carriage motor does not increase. Accordingly, it is possible to attain a small-sized carriage motor.

The cap may have a first side adapted to oppose the liquid ejecting head, and a second side opposite to the first side. The regulator may include a leg provided in the second side of the cap.

With this configuration, relative to the moving direction of the capping unit between the first position and the second position, it is possible to position the cap at the first position with high precision with respect to the base with the simple structure.

The capping unit may be configured such that, when the capping unit is moved from the second position to the first position, the cap and the slider are first moved together, the leg is then abutted against the base so that only the cap is stopped, and the slider is finally stopped.

With this configuration, relative to the moving direction of the capping unit between the first position and the second position, it is possible to position the cap at the first position with high precision without depending on the position of the slider.

The base may comprise an engagement member adapted to be engaged with the leg when the capping unit is placed in the first position. At least one of the leg and the engagement member may be formed with a tapered outer face.

With this configuration, at the first position, it is possible to determine the position of the cap in the directions orthogonal to the moving direction of the capping unit between the first position and the second position.

The head capping device may further comprise an urging member, disposed between the base and the slider and urging the slider toward the second position. The capping unit may be configured such that, when the capping unit is moved from the second position to the first position, the slider and the cap are moved together after the slider is abutted against the cap.

With this configuration, separately from the urging member for the slider, an independent urging member for the cap does not need to be provided.

In order to achieve at least one of the above objects, according to the invention, there is also provided a liquid ejecting apparatus, comprising: a liquid ejecting head, having a nozzle formation face formed with a nozzle orifice, and adapted to eject liquid from the nozzle orifice toward a target medium; and the above-described head capping device.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE EMBODIMENTS

Embodiments of the invention will be described below in detail with reference to the accompanying drawings.

Figure 1:
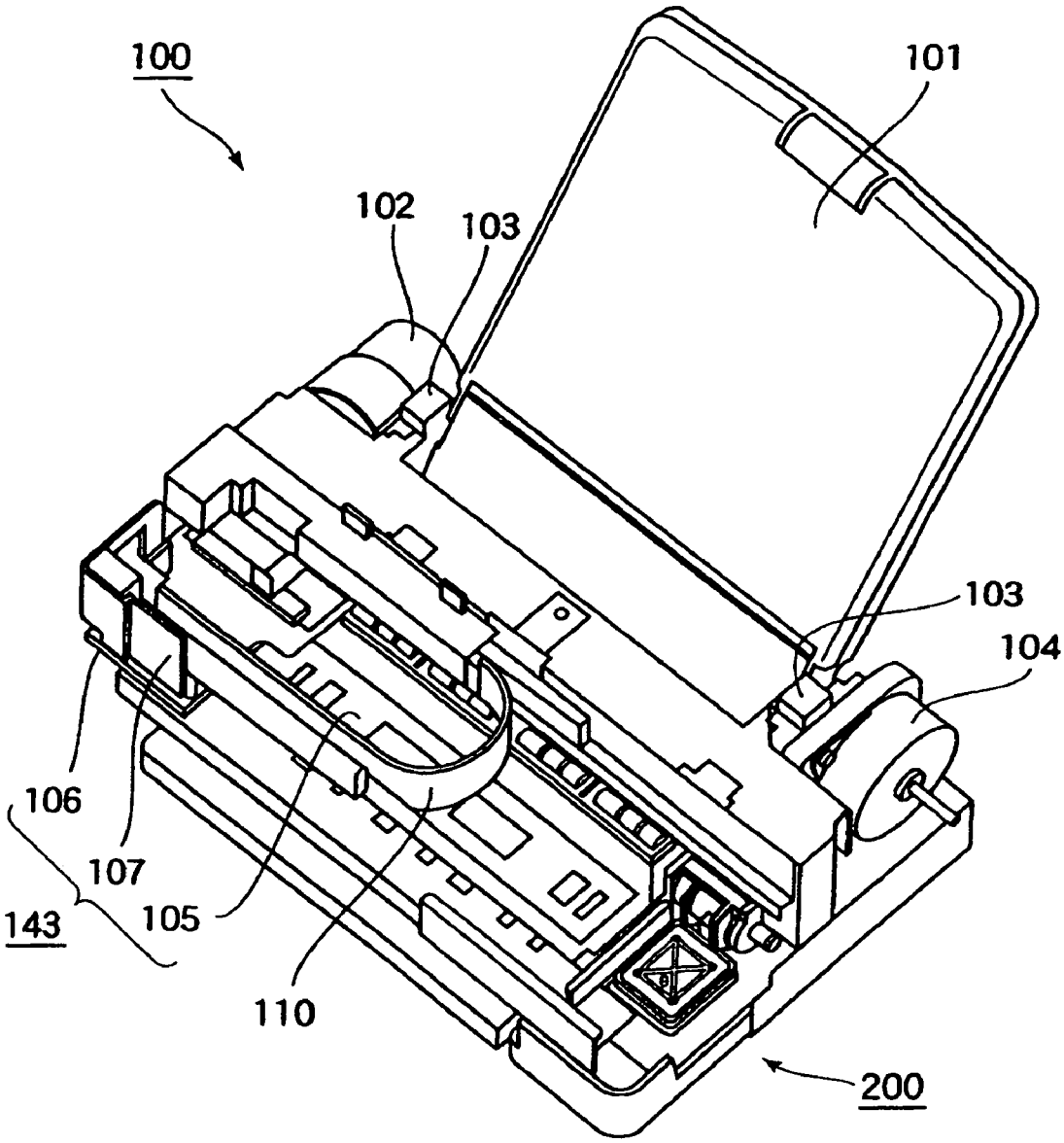
FIG. 1 is a perspective view showing a recording apparatus (liquid ejecting apparatus) incorporating a head capping device according to a first embodiment of the invention.
Figure 2:
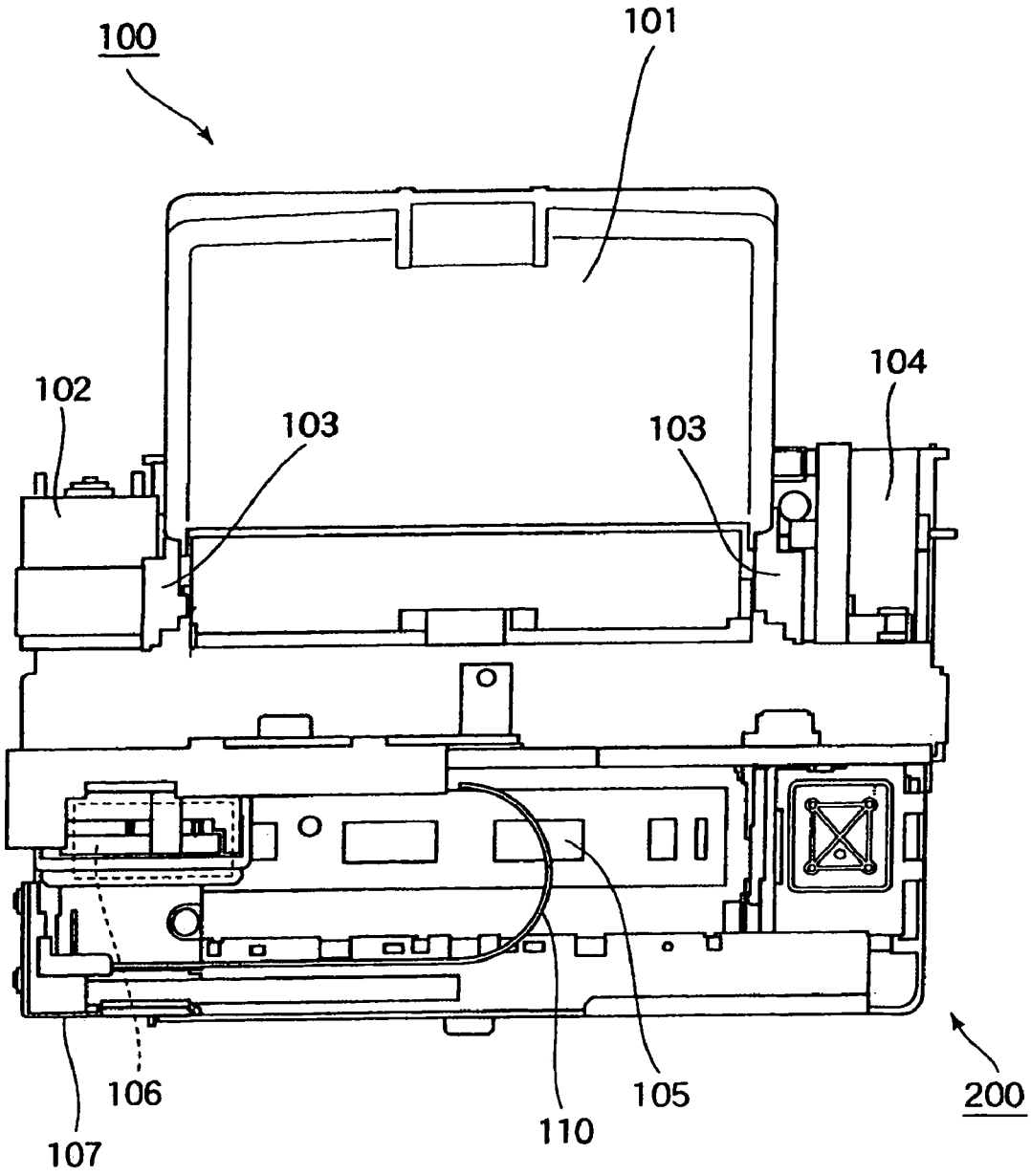
FIG. 2 is a top plan view of the recording apparatus.

As shown in FIGS. 1 and 2, on a rear side of a main body of a recording apparatus 100, a feeder cassette 101 in which paper serving as a recording medium is laminated is detachably provided. The uppermost paper in the feeder cassette 101 is picked up by a sheet feeding roller (not shown) that is driven by a sheet feeding motor 104 and then guided to a sheet guide 103, and it is fed to a sheet transporting roller (not shown) of a downstream side of a sheet transporting direction. The paper is further transported to a recording region 143 of the downstream side of the sheet transporting direction by the sheet transporting roller that is driven by a sheet transporting motor (not shown).

In the recording region 143, there are provided a platen 105 that supports the lower surface of the paper and a carriage 107 that is provided so as to oppose the platen 105. In this case, the carriage 107 is driven by a carriage motor 102 while being guided to a carriage guide shaft (not shown) that extends in a primary scanning direction. On a bottom face of the carriage 107, a recording head 106 is provided which ejects ink onto the paper. Further, the paper, which has been recorded by the recording region 143, is further carried to the downstream side and then ejected from a front side of the recording apparatus 100 by a sheet ejecting roller (not shown).

In addition, an ink cartridge (not shown) is loaded below the main body of the recording apparatus 100, and the ink is supplied to an ink supplying path (not shown) through an ink supplying needle (not shown). Further, the ink is supplied to the recording head 106 of the carriage 107 through an ink supplying tube 110. In addition, at the time of flushing or cleaning of the recording head 106, in an ink sucking device 200 which is provided in the home position side to perform ink sucking operation to maintain an ink ejecting characteristic of the recording head 106.

Figure 3:
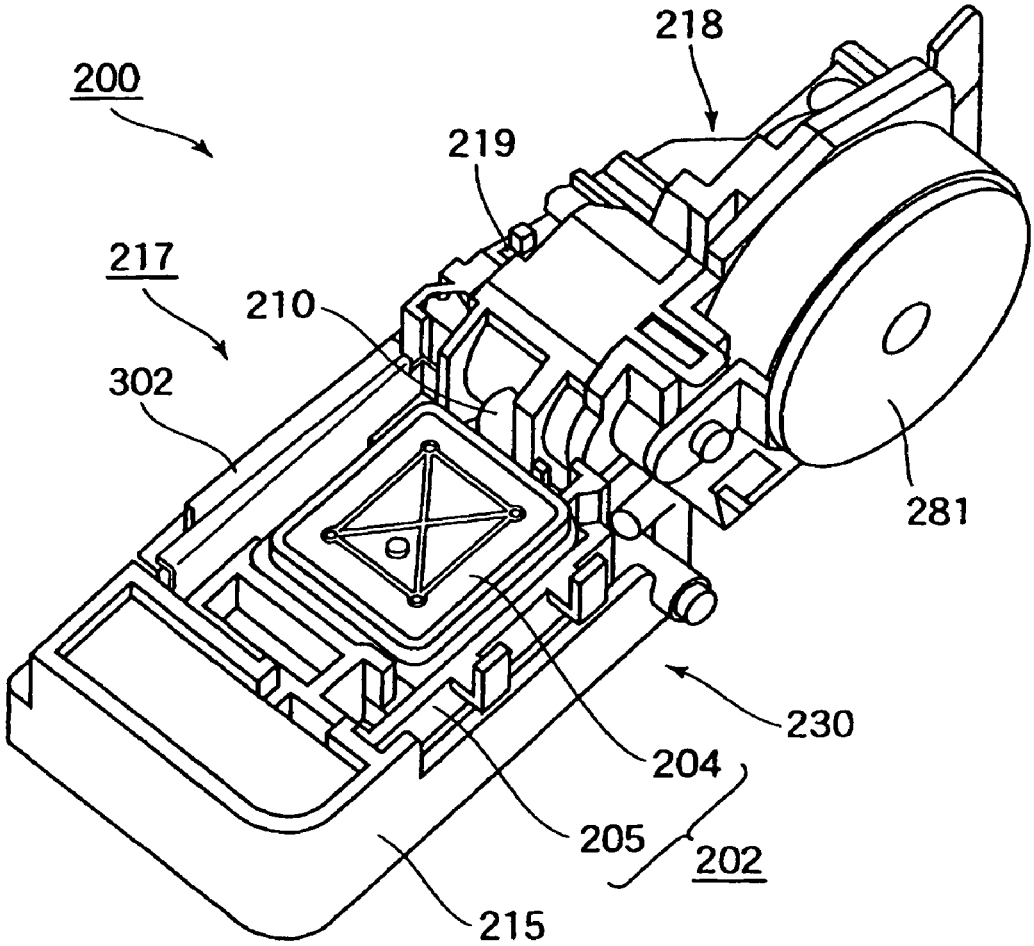
FIG. 3 is a perspective view of the head capping device.
Figure 4:
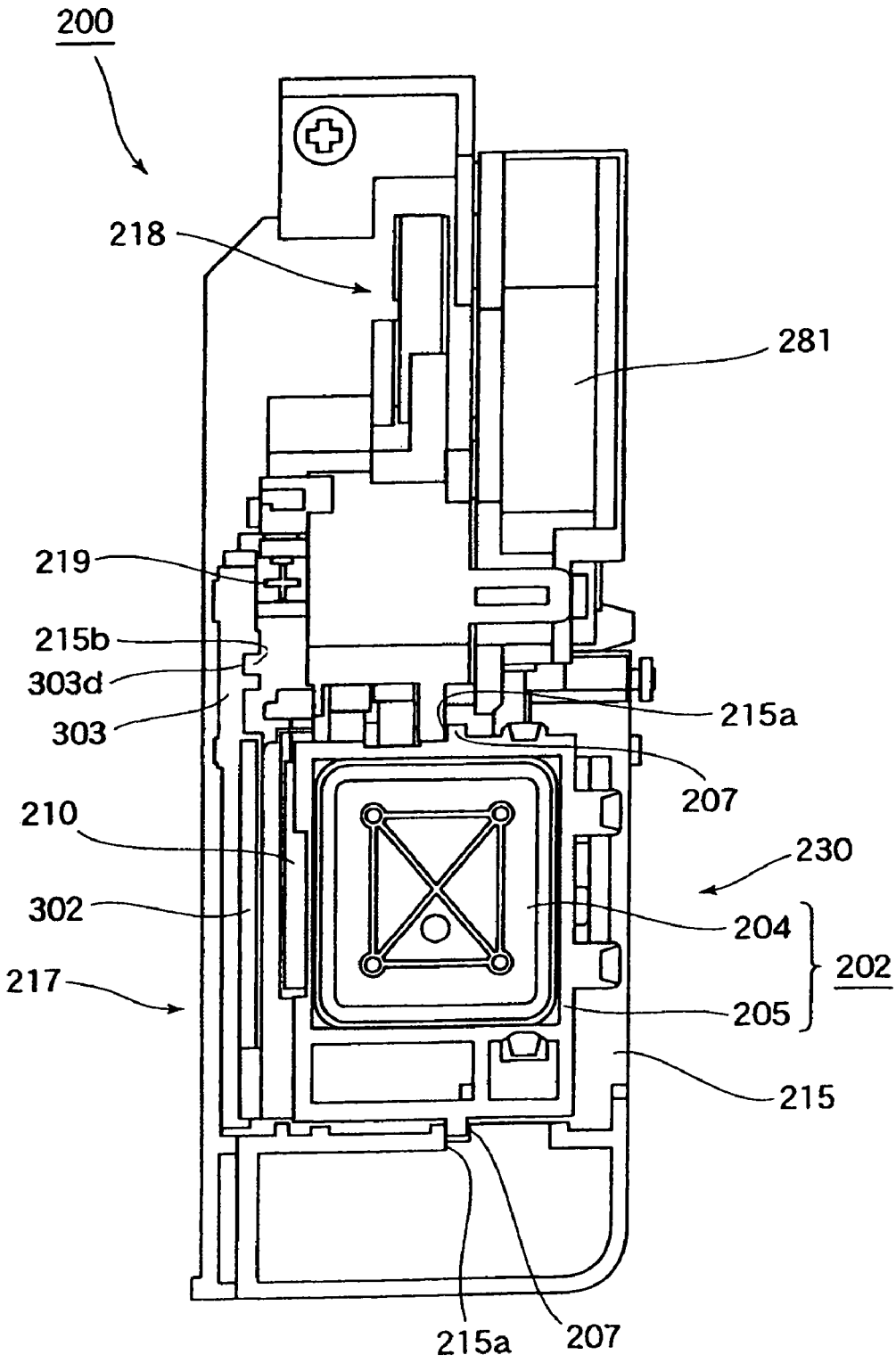
FIG. 4 is a top plan view of the head capping device.

As shown in FIGS. 3 and 4, the ink sucking device 200 comprises a head capping device 230 that can come into contact with the recording head 106. The head capping device 230 comprises a capping unit 202. The capping unit 202 has a cap 204 that seals the recording head 106, and a slider 205 that moves together with the cap 204 so as to be adjacent to or spaced apart from the recording head 106. As shown in FIG. 4, a slider guide 215*a* is provided in a base 215, and a slider rib 207 is provided on one side of the slider 205. The slider guide 215*a* and the slider rib 207 come into contacts with each other, which results in positioning the slider 205.

In addition, the ink sucking device 200 comprises a gear unit 218 which transmits motive power from the sheet transporting motor or the sheet feeding motor 104. The gear unit 218 transmits motive power to a suction pump 281 that sucks the inside of the capping portion of the head capping device 230 so as to depressurize the inside of the capping member. A lever 210 is provided in the base 215 and engages with the slider 205 to allow the slider 205 to move so as to be adjacent to or spaced apart from the recording head 106. Specifically, the slider 205 is urged to the recording head side by a spring 211 (see FIGS. 7 to 12) disposed between the base 215 and the slider 205. Here, the lever 210 receives the motive power from the gear unit 218, pivots so as to be against spring force of the spring 211, and moves the slider 205 and the cap 204. The detailed description of the operation will be made below with reference to FIGS. 7 to 12. In addition, the cap 204 is constructed so that air can be sent from a vent valve 219 through a vent tube 242 (see FIG. 5).

In addition, the ink sucking device 200 further comprises a head wiping device 217 which comprises a wiper 302 that can come into contact with a nozzle formation face 106*b* of the recording head 106 so as to wipe off the ink adhered thereon. The head wiping device 217 is provided so that it engages with a wiper guide rib 215*b* provided on the base 215 and a guide groove 303*d* provided on a wiper base 303 so as to be guided in a vertical moving direction.

Figure 5:
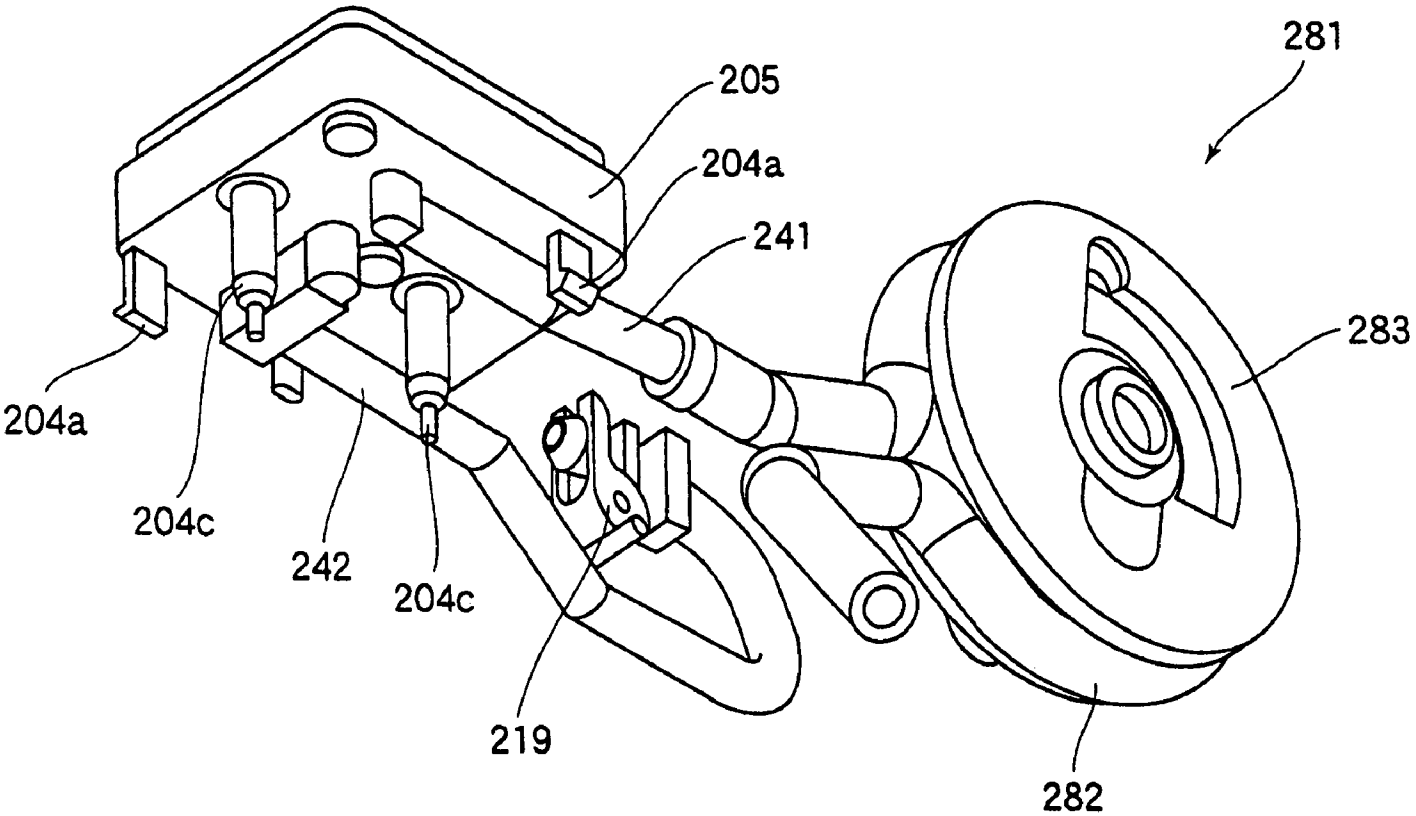
FIG. 5 is a perspective view of an ink sucking device provided with the head capping device.

As shown in FIG. 5, a decompressor 283 that is rotatable is provided in the suction pump 281, and a pump tube 282 that is formed of an elastic material is provided around the circumference of the decompressor 283. One end of the pump tube 282 is connected to the suction tube 241 that is connected to the bottom portion of the cap 204. A protrusion (not shown) is provided around the circumference of the decompressor 283. When the decompressor 283 rotates, the protrusion serves to squeeze out the air in the pump tube to the other end of the pump tube 282. That is, the air, which exists on one end side of the inside of the pump tube, can move to the other end side of the pump tube. Accordingly, the suction pump 281 can generate the negative pressure in the cap through the suction tube 241.

Here, on one end side of the vent tube 242 that is connected to the bottom portion of the cap 204, the vent valve 219 is provided. The vent valve 219 can open by an actuator (not shown) so that the air can be sent to the inside of the cap. Accordingly, when the pressure of the inside of the cap is turned into the negative pressure by the suction pump 281, the vent valve 219 can opens so that the negative pressure state of the cap 204 can be released.

Figure 6:
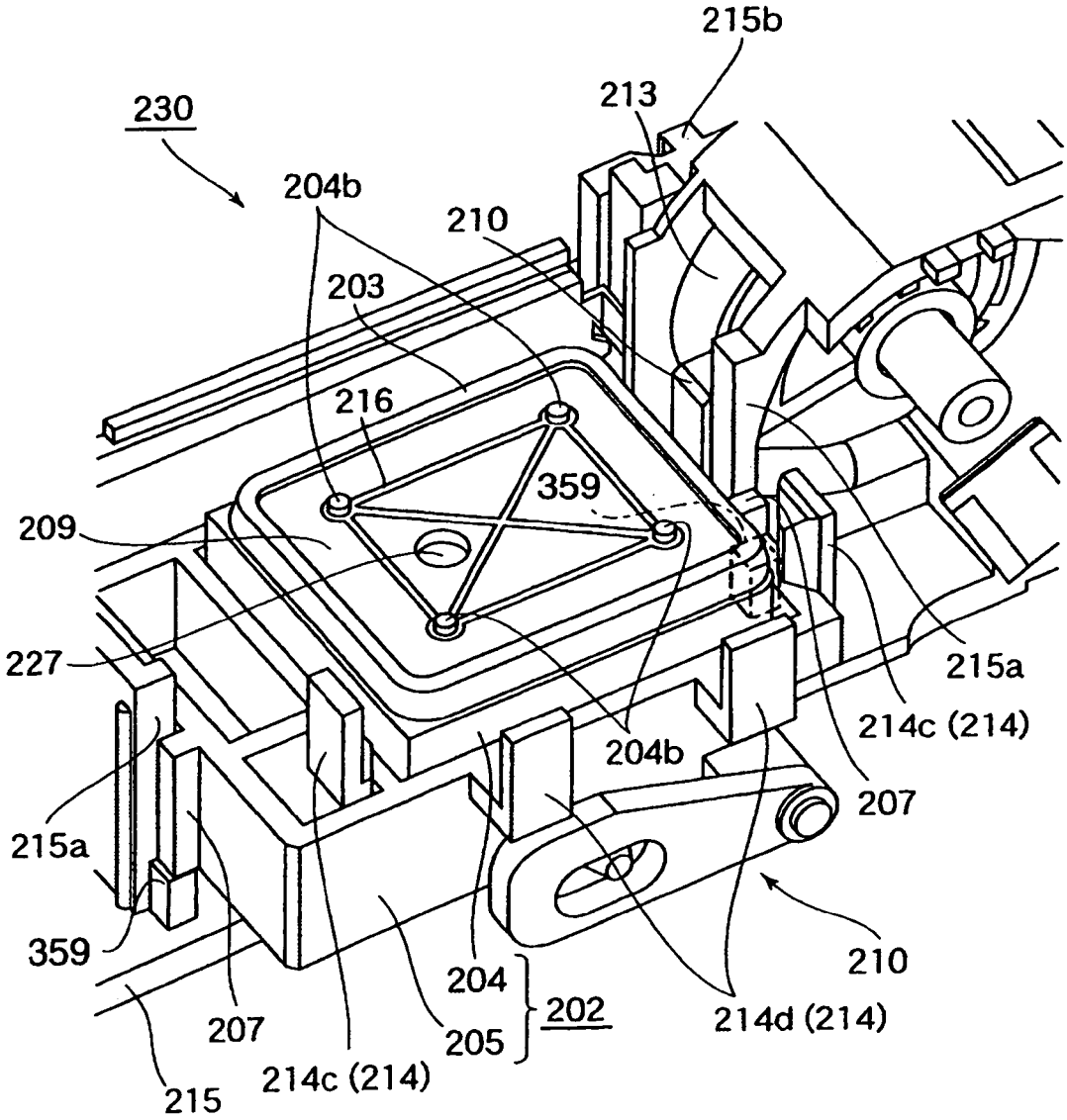
FIG. 6 is an enlarged perspective view showing a main portion of the head capping device.

As shown in FIG. 6, the abutment face 203 is formed of an elastic body on the cap 204 so that it can surely seal the nozzle formation face 106*b*. In addition, in the cap, an ink absorbing member 209 is provided which can absorb the ink ejected from the nozzle orifice. The ink absorbing member 209 is held by a retainer 216 that is welded to posts 204*b* extending from the bottom of the inner space of the cap 204 by thermal caulking or the like. In addition, the vent port 227 is formed in the cap 204, and the vent port 227 communicates with the vent valve 219 through the vent tube 242 that is connected to the bottom face of the cap 204.

The slider 205 is provided with a first claw 214*c* which can come into contact with the upstream side face and the downstream side face relative to a secondary scanning direction (sheet transporting direction) of the recording head 106 when the recording head 106 is placed in the home position. In addition, the slider 205 is provided with a second claw 214*d* which can come into contact with home position side face of the recording head 106 when the recording head 106 is placed in the home position.

In addition, on the downstream side of the gear unit 218 relative to the power transmitting direction, a cam 213 is provided. The cam 213 comes into contact with the lever 210 (which will be described in detail below) so as to pivot the lever 210, and thus moves the slider 205 and the gear portion 204.

In addition, in the base 215, at a first position that will be described in detail below, a pair of slider position regulators 359, which come into contact with lower ends of the slider ribs 207, are provided.

Next, the operation of the lever 210, the slider 205, and the cap 204 when the cam 213 rotates will be described below. In this case, the first position of the head capping device 230 refers to a state that is spaced apart from the recording head 106, and the second position of the head capping device 230 refers to a state that comes into contact with the recording head 106 to seal a nozzle orifice array 106*a* composed of nozzle orifices.

Figure 7:
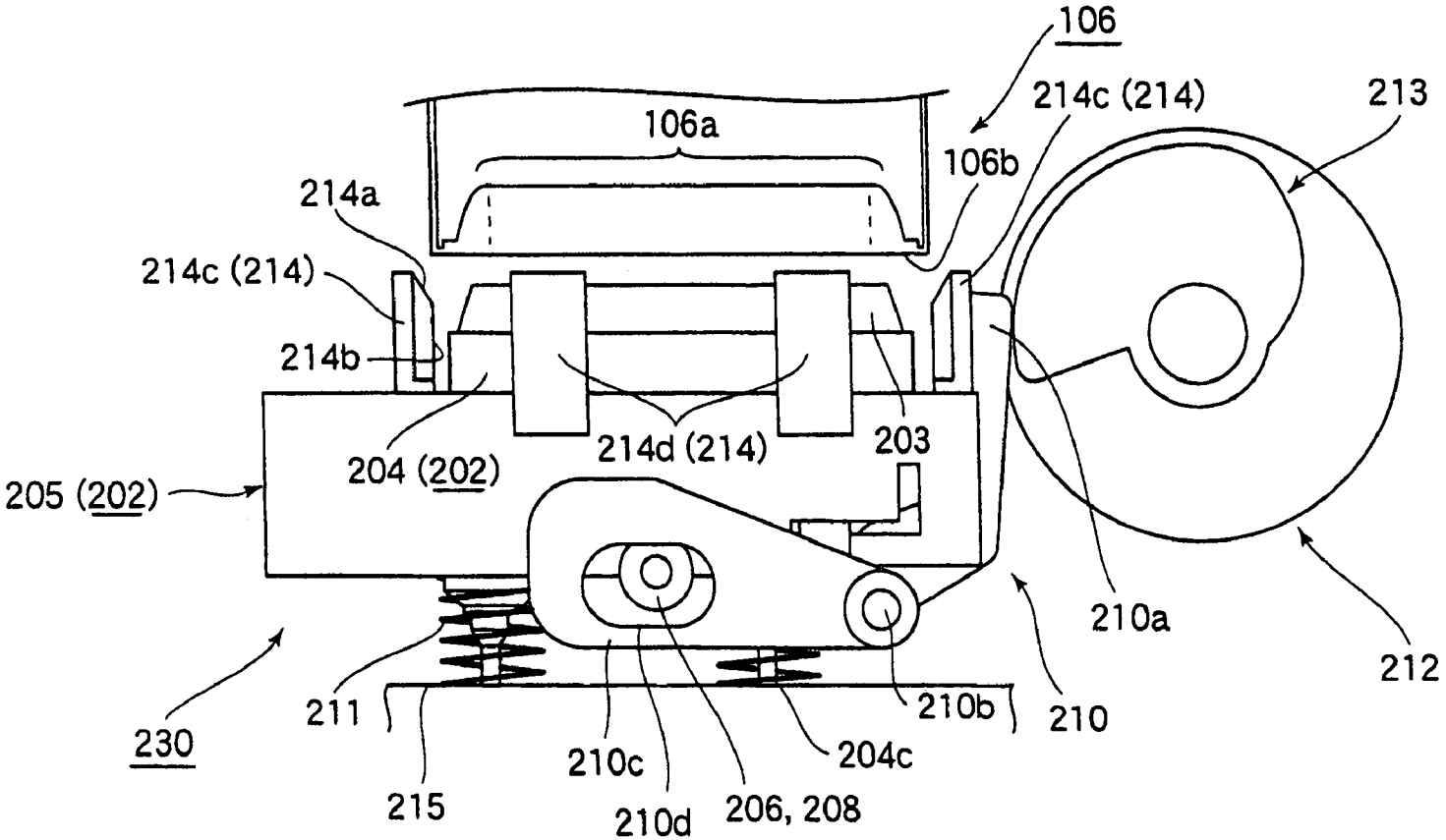
FIG. 7 is a side view showing a state that the head capping device is placed in the first position thereof.
Figure 8:
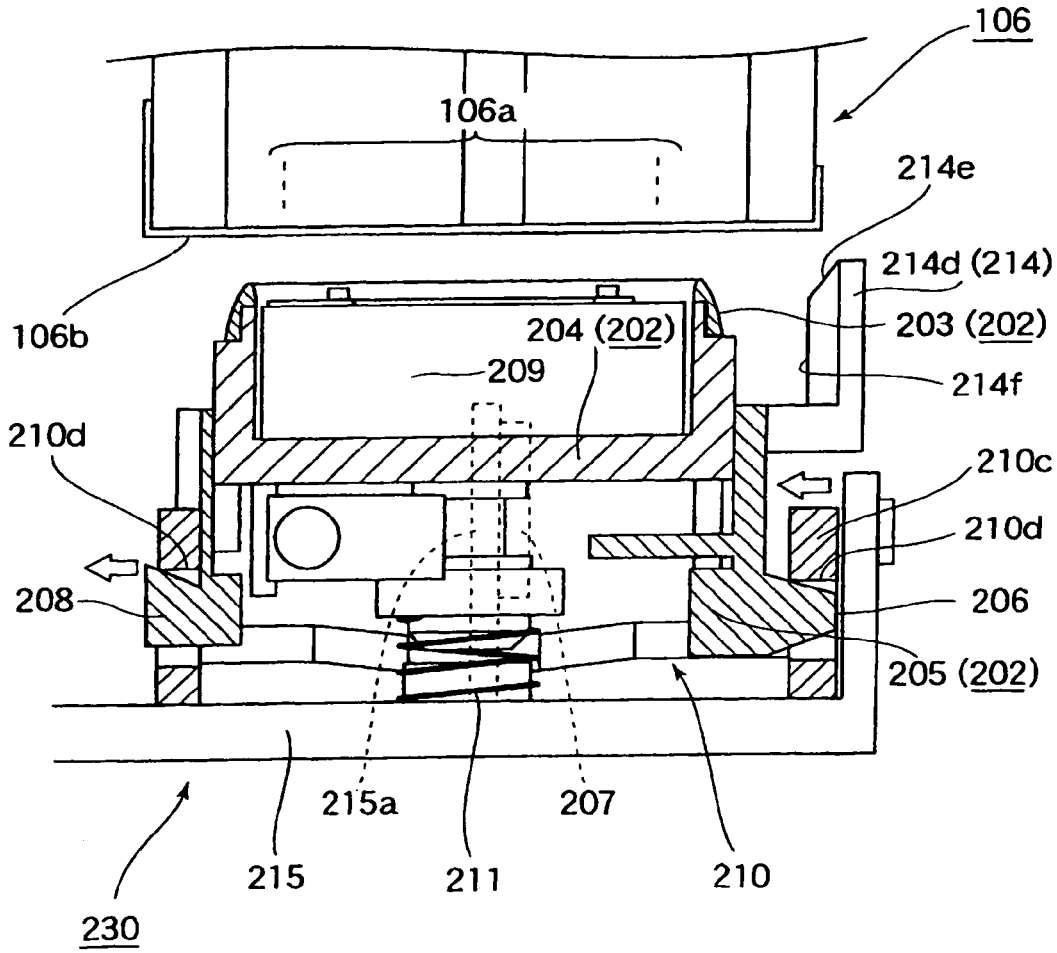
FIG. 8 is a section view of the head capping device of FIG. 7 taken along a line extending in a primary scanning direction of a recording head in the recording apparatus.

As shown in FIGS. 7 and 8, the slider 205 is urged to the recording head side by the spring 211 that is provided between the slider 205 and the base 215.

On the right side of FIG. 7, a cam gear 212 having the cam 213 is rotatably provided so as to be against the spring force of the spring 211. The cam 213 comes into contact with a first arm 210*a* that is formed on one end of the lever 210, so that the cam 213 can pivot the lever 210 on the basis of a pivot shaft 210*b*. In addition, a second arm 210*c* is formed on the other end of the lever 210, and an opening 210*d* formed in the second arm 210*c* engages with a first tapered projection 206 and a second tapered projection 208 that are formed on the slider 205. Accordingly, as shown in FIG. 7, the cam 213 comes into contact with the first arm 210*a*, so that the cam 213 pivots the lever 210 in a counterclockwise direction in the figure so as to push down the slider 205.

In addition, on the bottom face of the cap 204, legs 204*c* are provided so as to come into contact with the base 215. These legs 204*c* are inserted into leg receiving holes 363 (see FIGS. 15 to 17) that are formed in the bottom of the slider 205. That is, the spring 211 does not directly come into contact with the cap 204, but comes into contact with the slider 205 so as to urge the same. In this way, the spring 211 can indirectly urge the cap 204 through the slider 205. Accordingly, in FIGS. 7 and 8, the slider 205 is lowered by the cam 213 and the lever 210 to the position at which any force is not applied to the cap 204. In addition, the leg 204*c* comes into contact with the base 215, so that the cap 204 is positioned in the vertical direction.

In addition, a first slope face 214*a* and a second slope face 214*e* are respectively provided in the first claw 214*c* and the second claw 214*d* so that they come into contact with the recording head 106 and smoothly guide the slider 205. In addition, as shown in FIG. 6, a first abutment face 214*b* of the first claw 214*c* and a second abutment face 214*f* of the second claw 214*d* are narrowed in order to reduce frictional resistance between the first claw 214*c* or the second claw 214*d* and the recording head 106.

On the nozzle formation face 106*b*, the nozzle orifice array 106*a* is formed within a range smaller than a size of the cap 204.

As shown in FIG. 8, the first tapered projection 206 and the second tapered projection 208 of the slider 205, which engages with the opening 210*d* of the second arm 210*c*, are tapered in the same direction. In this case, as described above, the slider 205 is urged by the spring 211 upward in FIG. 8. On the other hand, the slider 205 is urged downward by the lever 210 so as to be against the spring force. By the opening 210*d*, the first tapered projection 206, and the second tapered projection 208, the slider 205 is urged leftward in FIG. 8, that is, to the away position side. Incidentally, the slider rib 207 of the slider 205 shown in FIG. 4 is restricted by the slider guide 215*a* of the base 215, and positioned in the primary scanning direction.

Figure 9:
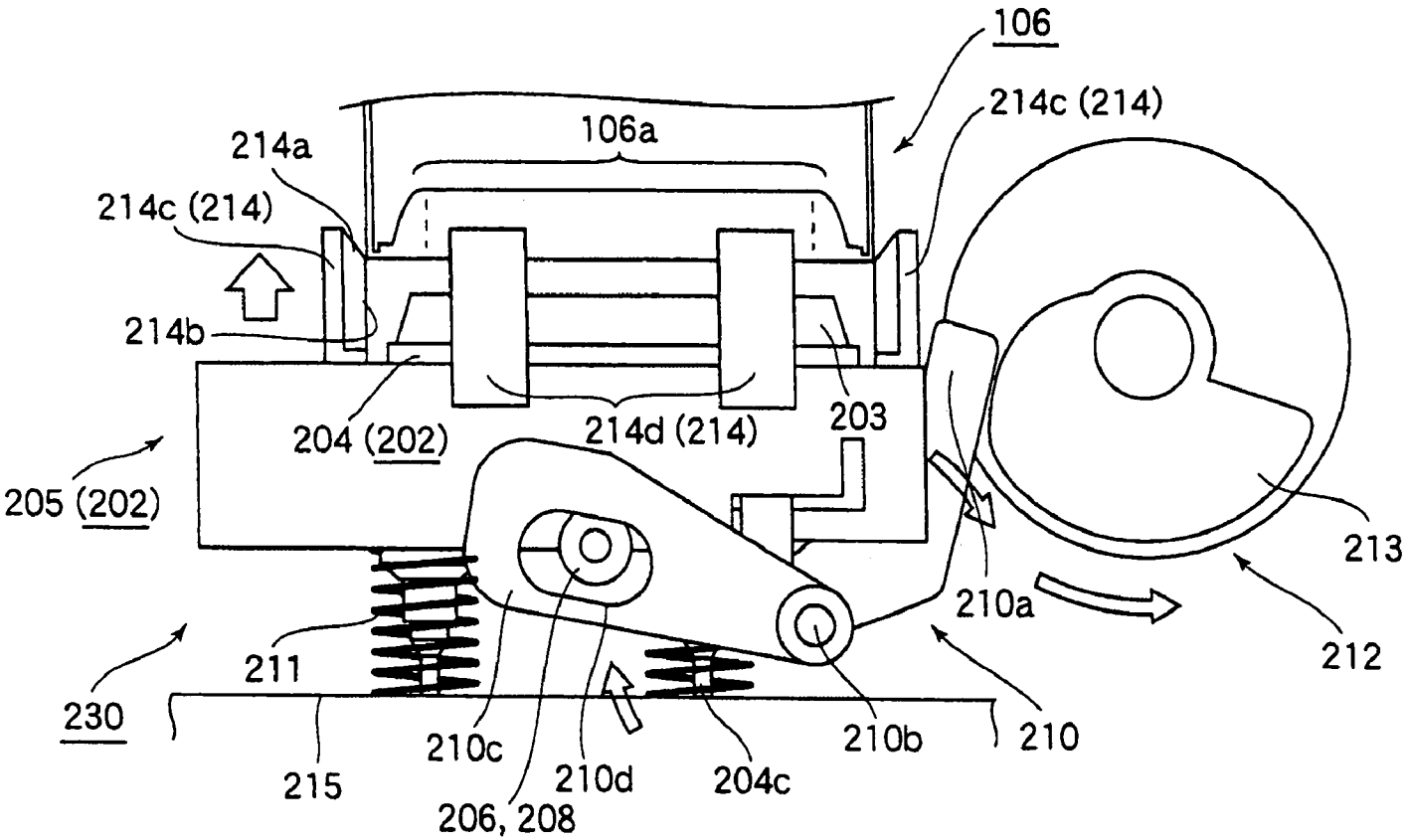
FIG. 9 is a side view showing a state that the head capping device is moved from the first position to the second position thereof.

As shown in FIG. 9, if the cam gear 212 rotates in the counterclockwise direction in the figure, the cam 213 gradually retreats, and thus the lever 210, which is in contact with the arm gear 212, gradually pivots in a clockwise direction. In addition, as the lever 210 pivots, the slider 205 gradually moves to the recording head side.

Further, if the arm gear 212 rotates in the counterclockwise direction, the slider 205 further moves to the recording head side. The first slope face 214*a* of the first claw 214*c* or the second slope face 214*e* of the second claw 214*d* come into contact with the lower portion of the side face of the recording head 106. This state is illustrated in FIGS. 9 and 10.

In this state, if the cam gear 212 further rotates in the counterclockwise direction, the slider 205 further moves the recording head side. Accordingly, the lower portion of the side face of the recording head 106 gradually goes down the first slope face 214*a* of the first claw 214*c* or the second slope face 214*e* of the second claw 214*d* so as to come into contact with the first abutment face 214*b* of the first claw 214*c* or the second abutment face 214*f* of the second claw 214*d*. That is, the relative positional relationship between the slider 205 and the recording head 106 are determined with high precision by the first claw 214*c* and the second claw 214*d*.

Figure 10:
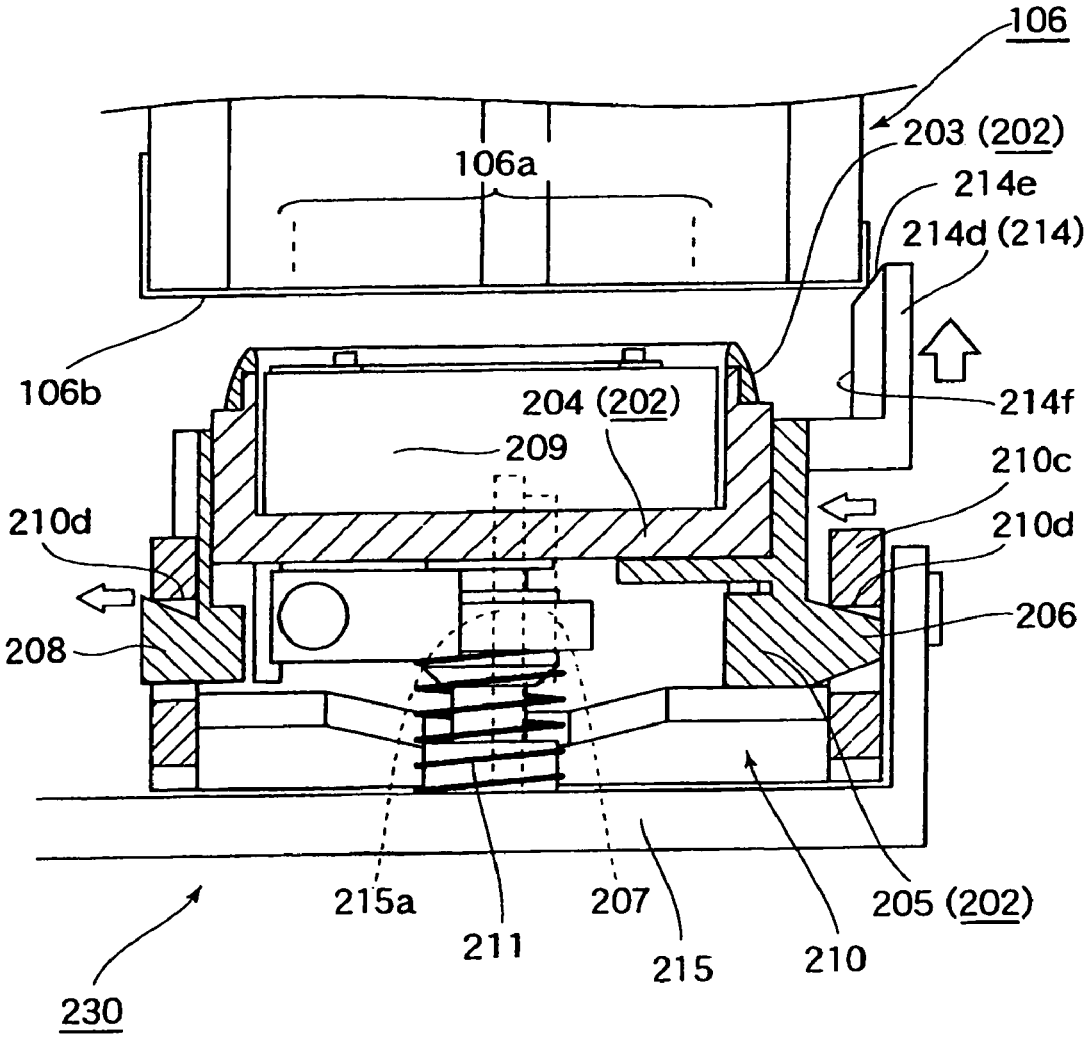
FIG. 10 is a section view of the head capping device of FIG. 9 taken along a line extending in the primary scanning direction.

Incidentally, as shown in FIG. 10, the slider 205, which is guided to the second slope face 214*e* of the second claw 214*d* that comes into contact with the bottom side of a side face of home position side of the recording head 106, moves to a right side in the figure, that is, to home position side. Specifically, the slider rib 207 of the slider 205 shown in FIG. 4 is spaced apart from the slider guide 215*a* of the base 215. In addition, the force by which the slider 205 is urged to the away position side by the opening 210*d*, the first tapered projection 206, and the second tapered projection 208 is regulated by the second claw 214*d* that comes into contact with the bottom side of the side face of the home position side of the recording head 106. Accordingly, since the second claw 214*d* can comes into contact with the bottom side of the side face of the home position side of the recording head 106 without the clearance, the slider 205 is relatively positioned with respect to the recording head 106 with high precision in the primary scanning direction.

In addition, if the cam gear 212 rotates in a counterclockwise direction, the slider 205 further moves to the recording head side, and the bottom face of the slider 205 comes into contact with the bottom face of the cap 204 so as to move the cap 204 to the recording head side. That is, the leg 204*c* of the cap 204 is spaced apart from the base 215, and the cap 204 is move to the recording head side together with the slider 205.

Figure 11:
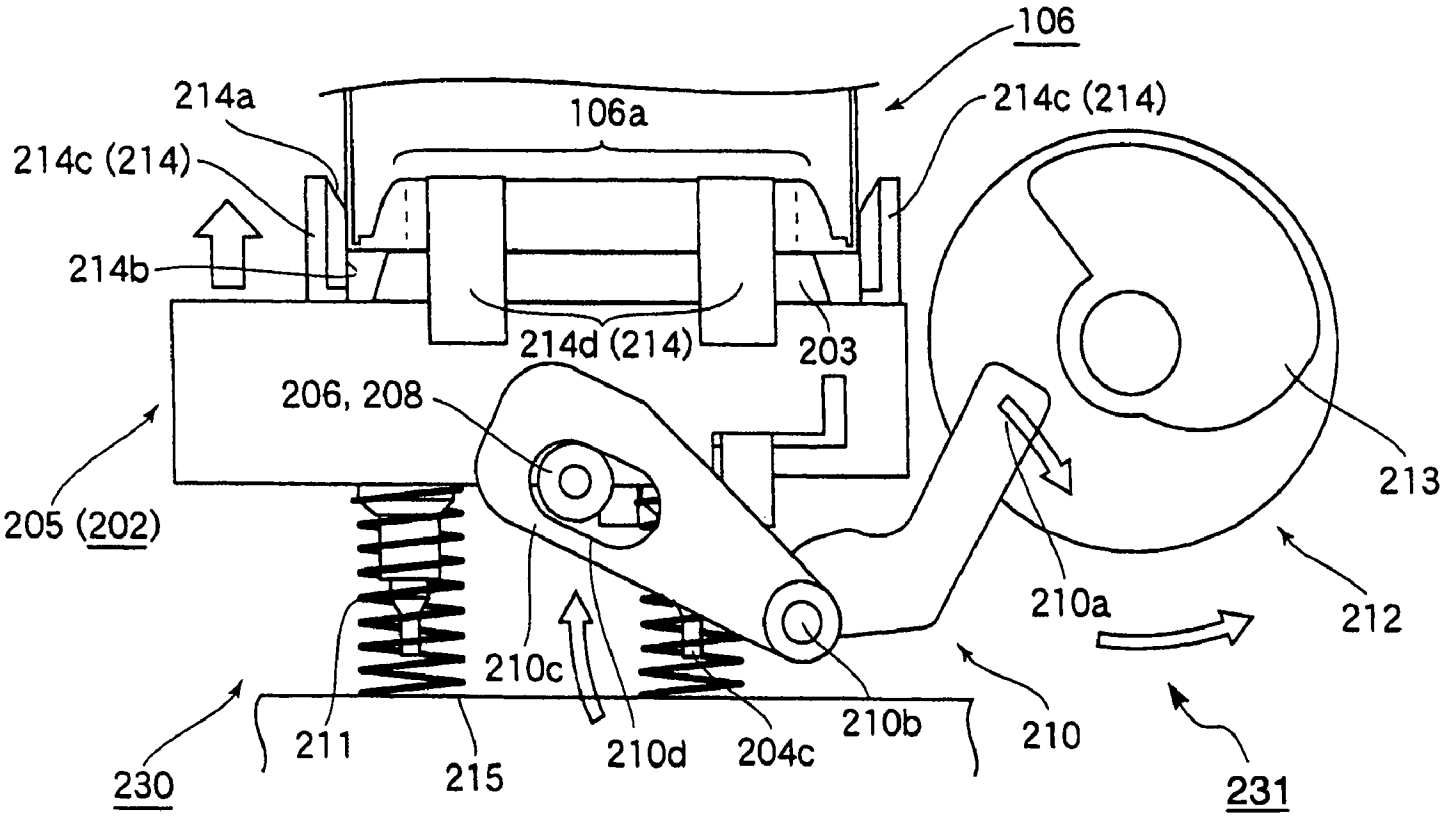
FIG. 11 is a side view showing a state that the head capping device is placed in the second position.
Figure 12:
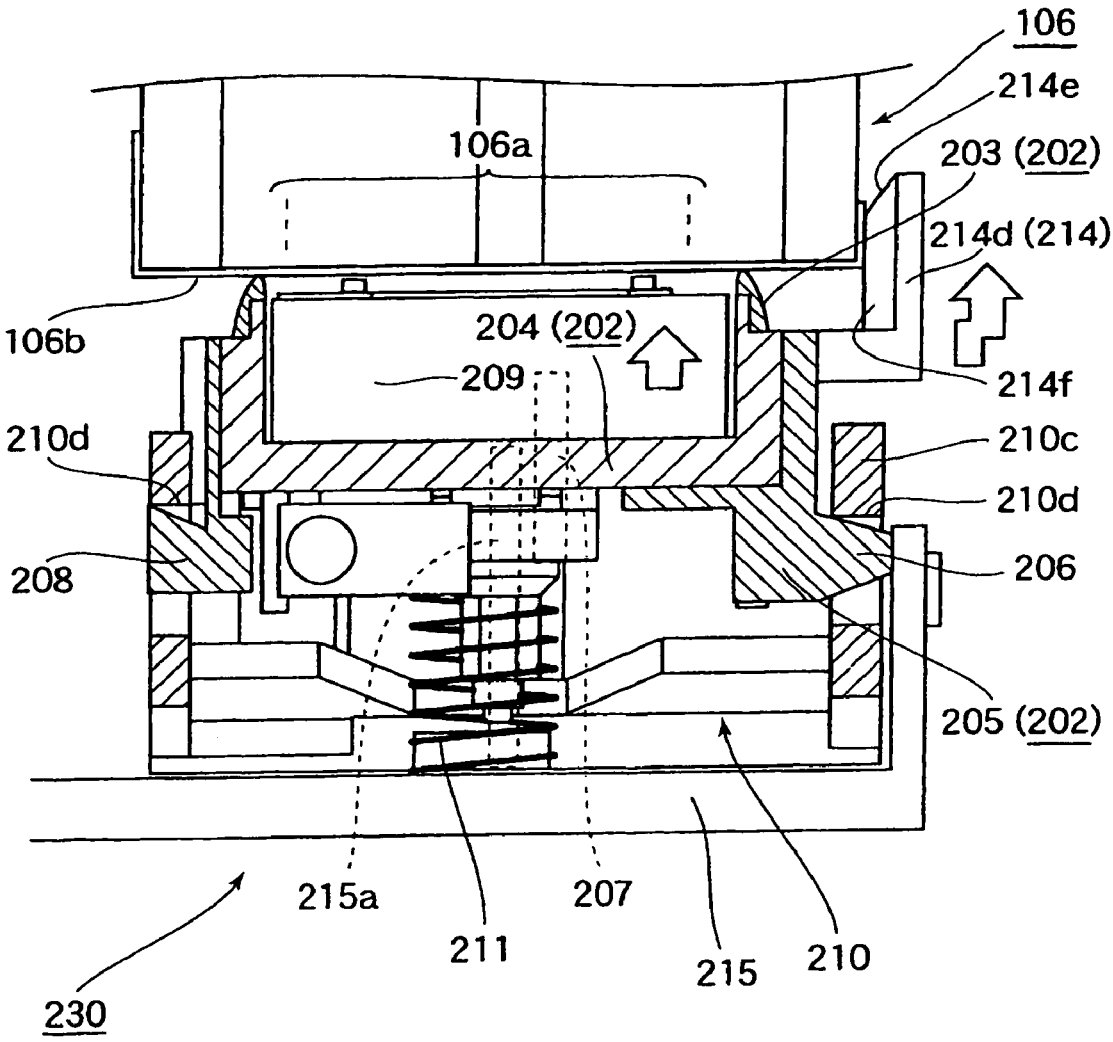
FIG. 12 is a section view of the head capping device of FIG. 11 taken along a line extending in the primary scanning direction.

The cam gear 212 further rotates in the counterclockwise direction from the state shown in FIGS. 9 and 10, and the cam 213 is spaced apart from the lever 210. In this case, as shown in FIGS. 11 and 12, the slider 205 and the cap 204 moves to the recording head side while being guided to the first abutment face 214*b* of the first claw 214*c* and the second abutment face 214*f* of the second claw 214*d*, and the abutment face 203 of the cap 204 comes into contact with the nozzle formation face 106*b* of the recording head 106. If the cap 204 comes into contact with recording head 106, the lever 210 is made free. That is, since the lever 210 does not come into contact with the cam 213, no action is taken with respect to the slider 205. Accordingly, the force by which the slider 205 is urged to the away position side by the opening 210*d*, the first tapered projection 206, and the second tapered projection 208 is not generated. That is, the extra urging force is released in the primary scanning direction at the same time as the cap 204 coming into contact with the recording head 106. As a result, the cap 204 can surely seal the nozzle formation face 106*b*.

That is, the cam 213, the lever 210, the first tapered projection 206, and the second tapered projection 208 serve as a motive power releaser 231 (see FIG. 11). At the second position, since the lever 210 does not come into contact with the cam 213 as described above, no action is taken with respect to the first tapered projection 206 and the second tapered projection 208. Accordingly, since no action is taken with respect to the opening 210*d*, the first tapered projection 206, and the second tapered projection 208, the force by which the slider 205 is urged to the away position side is not generated. That is, the motive power releaser 231 can make the force urged to the away position side not applied to the first tapered projection 206 and the second tapered projection 208 of the slider 205 in the second position.

Next, a sequence in which the capping unit 202 moves from the second position to the first position will be described.

In a state that the capping unit 202 shown in FIGS. 11 and 12 are at the second position, if the cam gear 212 rotates in the clockwise direction in FIG. 11, the cam 213, which is spaced apart from the lever 210, comes into contact with the first arm 210*a* of the lever 210. In addition, the cam 213 pivots the lever 210 in the counterclockwise direction in FIG. 11. Accordingly, as the cam 213 rotates, the second arm 210*c* can make the slider 205 engaging with the second arm 210*c* move to the position shown in FIGS. 9 and 10 so that the slider 205 gradually moves downward against the spring force of the springs 211.

Incidentally, since the lever 210 regulates the first tapered projection 206 and the second tapered projection 208 of the slider 205 so as to be against the spring force of each of the springs 211, the force by which the above-mentioned lever 210 urges the slider 205 from the home position side to the away position side is generated. Accordingly, when the capping unit 202 moves from the state shown in FIGS. 11 and 12 to the state shown in FIGS. 9 and 10, the second slope faces 214*e* of the second claws 214*d*, which are provided in the slider 205, come into contact with the recording head 106. That is, the slider 205 is guided to the second slope faces 214*e*, then moves downward in FIG. 10, and then moves to the away position side (that is, the left side). In addition, the pair of slider ribs 207 come into contact with a pair of slider guides 215*a* that are provided in the base 215.

When the slider 205 moves downward in FIG. 9, the two legs 204*c* come into contact with the base 215 so that the movement of the cap 204 in a downward direction is regulated. That is, it is possible to position the cap 204 at the first position with high precision in the heightwise direction. As a result, at the time of flushing operation, the distance between the recording head 106 and the cap 204 is decreased to the extent that mist is not generated, and set so that the recording head 106 and the cap 204 do not come into contact with each other.

In this embodiment, the legs 204*c* are provided below the cap 204 so as to come into contact with the base 215. However, in stead of the legs 204*c*, protrusions may be provided on the side face of the cap 204 so that the protrusions may come into contact with the base 215.

In this embodiment, the legs 204*c* come into contact with the base 215 of the head capping device 230. However, in stead of the base 215 of the head capping device 230, the legs 204*c* may come into contact with a fixed member of the recording apparatus 100 serving as the base. In such a case, it is possible to position the cap 204 with higher precision in the heightwise direction at the first position.

In the state shown in FIGS. 9 and 10, when the cam gear 212 further rotates in the clockwise direction in FIG. 9, the lever 210 further rotates in the counterclockwise direction. In addition, the lever 210 pushes down the slider 205 to the position of the slider 205 shown in FIGS. 7 and 8 so as to move only the slider 205 downward. Incidentally, the position in the moving direction between the position of the height direction of the slider 205 at the first position, that is, the first position and the second position is restricted by the position of the lever 210. The lower ends of the pair of slider ribs 207 come into contact with the pair of slider position regulators 359 (see FIG. 6) provided in the base 215, so that the slider 205 at the first position maintains the stable posture.

Figure 15B:
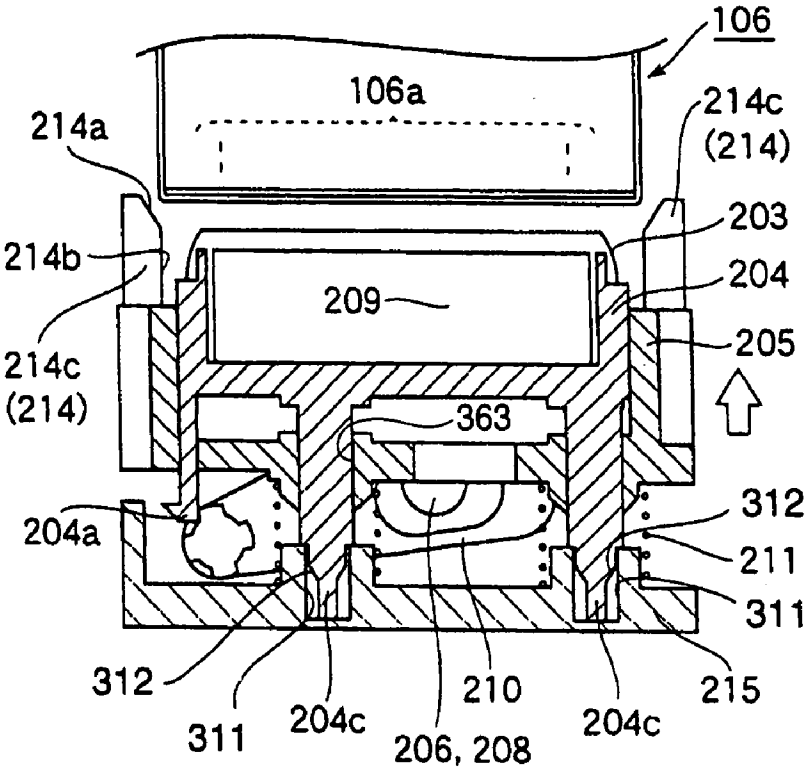
FIGS. 15A to 16B are section views of the head capping device viewed from a secondary scanning direction, showing states when the capping unit is moved from the first position to the second position.
Figure 16B:
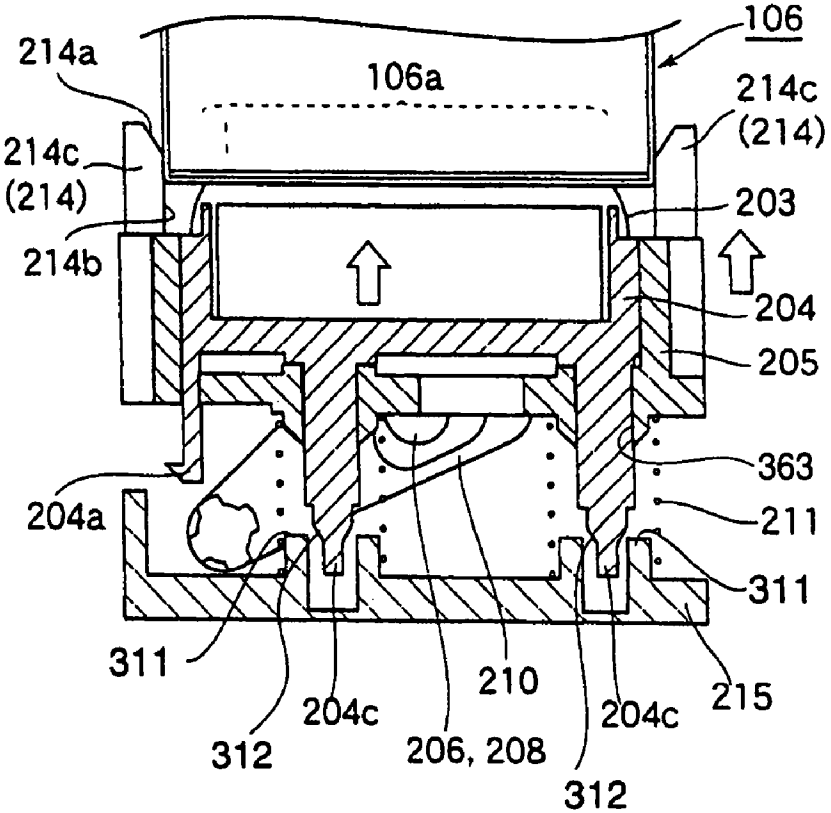
Figure 16A:
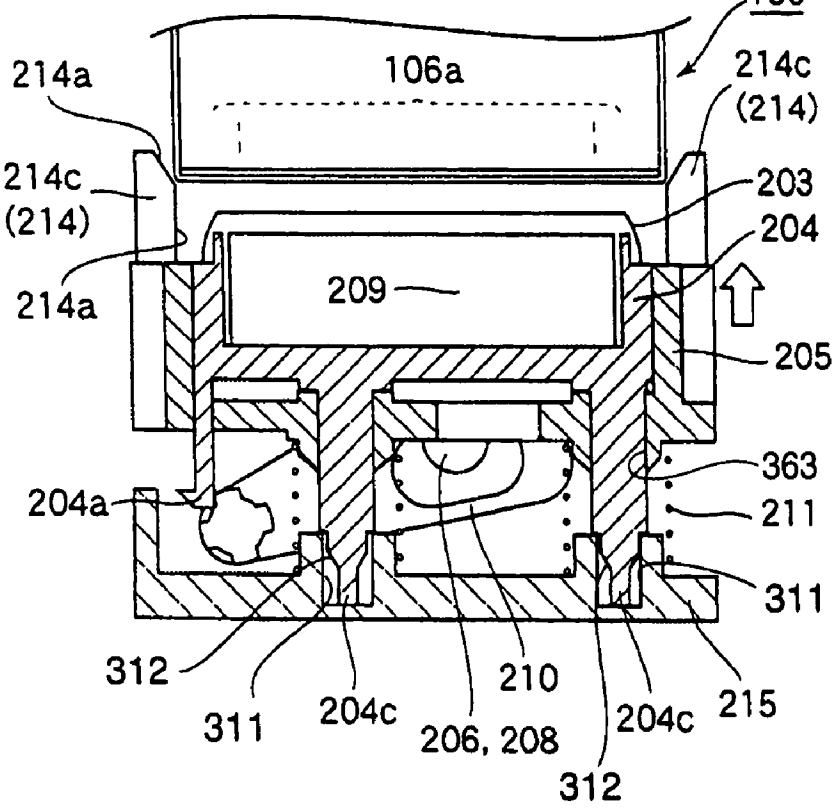
Figure 17:
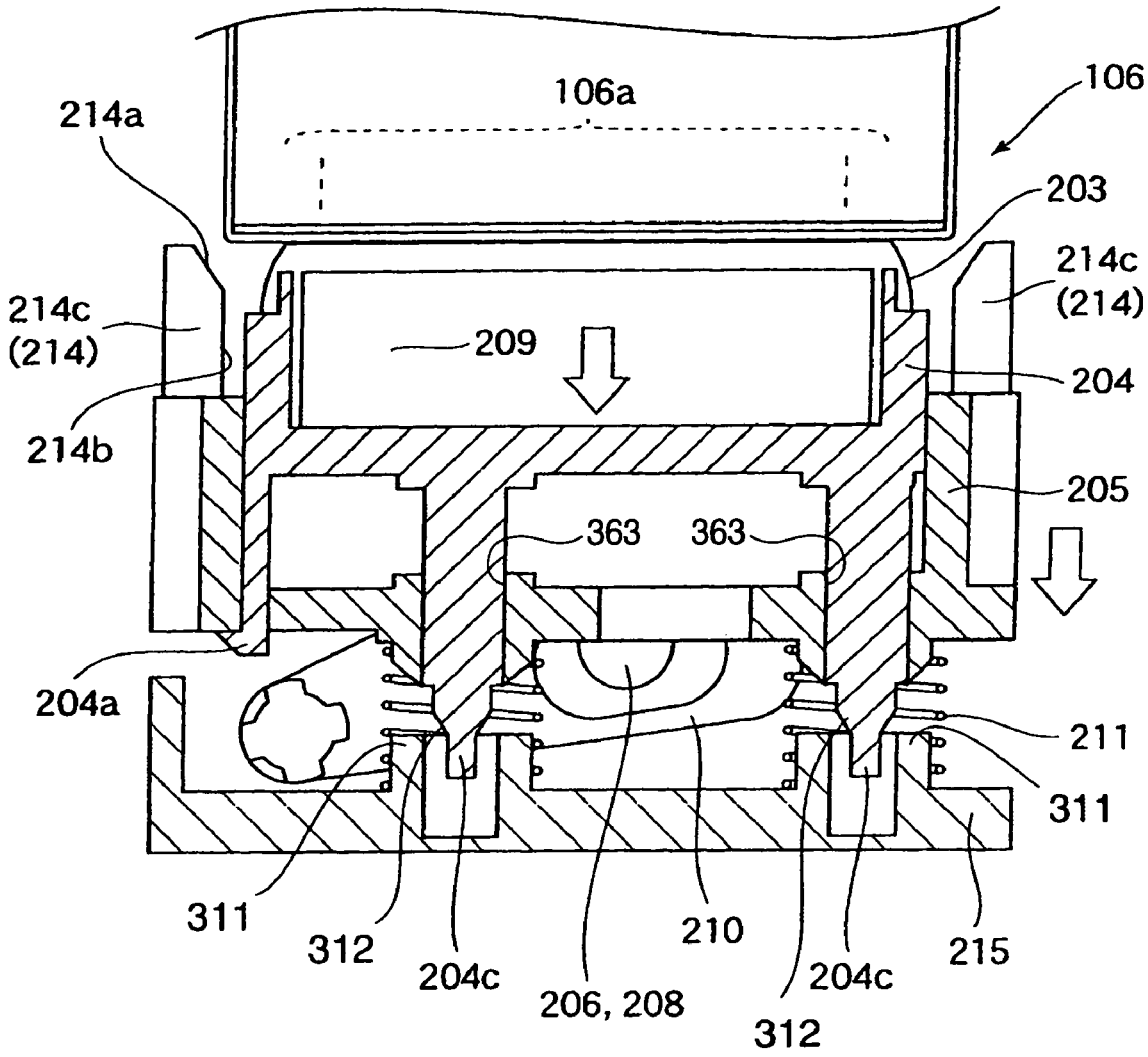
FIG. 17 are a section view of the head capping device viewed from the secondary scanning direction, showing a state that the capping unit adhered on the recording head is moved from the second position to the first position.

As shown in FIGS. 15 to 17, a tapered portion 312 is formed near the distal end of each of the legs 204*c* (see FIGS. 15 to 17).

When the cap 204 moves from the above-mentioned second position to the first position, the tapered portions 312 of the legs 204*c* come into contact with the leg receiving holes 311. Accordingly, the legs 204*c* can engage with the leg receiving holes 311 while being guided by the tapered portions 312. When the distal ends of the legs 204*c* abut against the bottom of the leg receiving holes 311, the movement of the cap 204 to the first position is completed. Incidentally, at the first position, the cap 204 is constructed so that it is positioned with high precision in not only the heightwise direction but also the primary scanning direction and the sub scanning direction.

In this embodiment, the tapered portion 312 is provided on the leg 204*c*. However, the tapered projection 312 may be provided on the leg receiving hole 311. In addition, the tapered portions 312 may be provided on both of the leg 204*c* and the leg receiving hole 311.

Figures 13A, 13B, 13C:
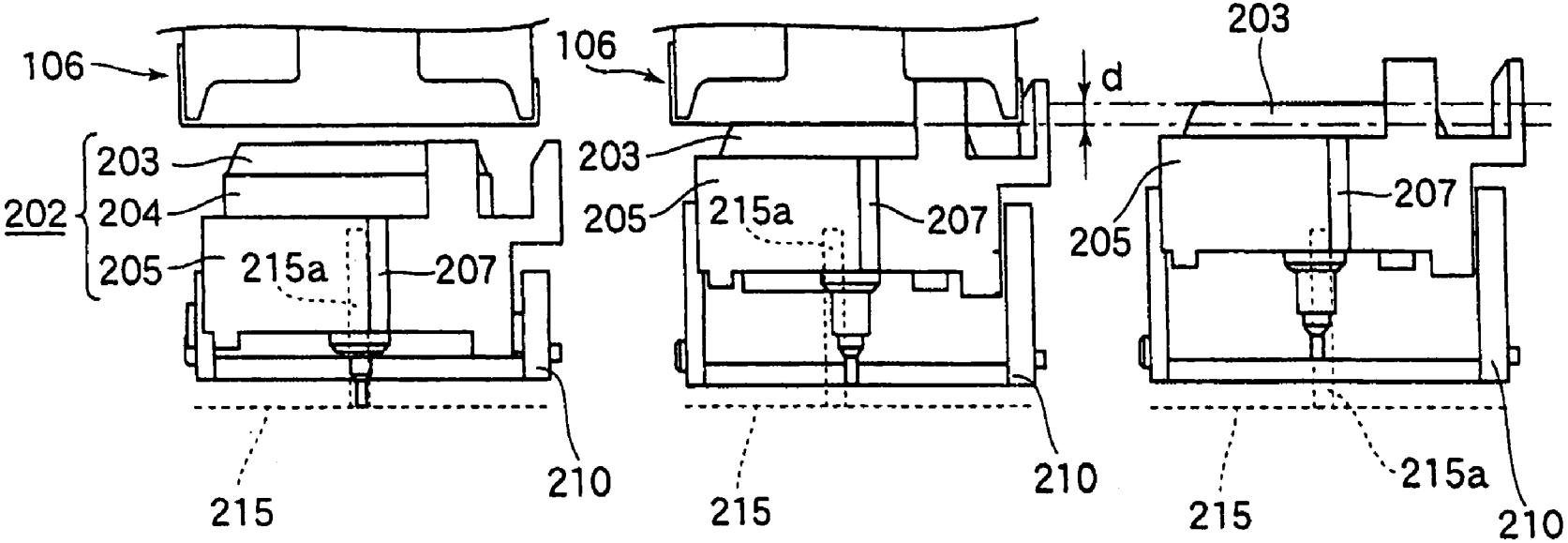
FIGS. 13A to 13C are side views for explaining the movable length of the head capping device.

Next, the movable length of the head capping device 230 will be described. FIG. 13A shows a state that the capping unit 202 is placed in the first position. FIG. 13B shows a state that the capping unit 202 is placed in the second position. FIG. 13C shows an upper limit of the movement of the head capping unit 202 in a case where the recording head 106 is not placed above the capping unit 202. As shown in FIG. 13C, since the safety margin "d" is secured in the movable length, the clearance is not generated between the cap 204 and the recording head 106 in the state shown in FIG. 13B. Accordingly, at the time of the suction operation, it is possible to surely depressurize the inside of the cap.

Figure 14:
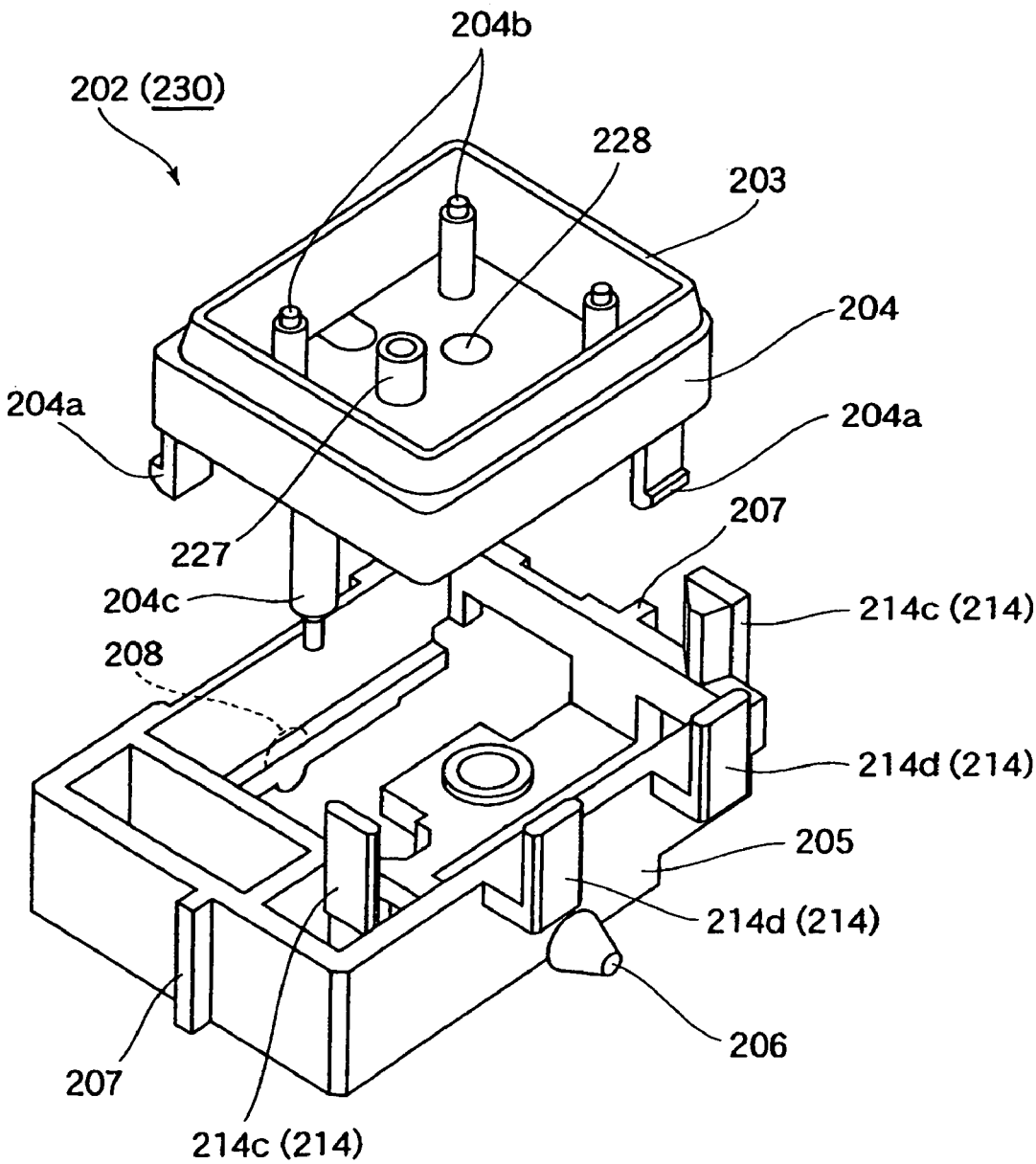
FIG. 14 is a perspective view showing a disassembled state of a capping unit in the head capping device.

As shown in FIG. 14, on the cap 204, the abutment face 203 is provided which comes into contact with the nozzle formation face 106*b* of the recording head 106 and which is formed of an elastic material. The posts 204*b* are provided in the cap 204, and the retainer 216 are secured to the top ends of the posts 204*b* to retain the ink absorbing member 209. A vent port 227 is provided such that a top end thereof is made flush with the top face of the ink absorbing member 209, so that air can be sent to the inside of the cap 204 through the vent valve 219. On the bottom face of the cap 204, the suction port 228 is provided. When the suction pump 281 is driven, the suction port 228 can send the ink held by the ink absorbing member 209 provided in the cap 204 to the suction pump 281. On the bottom face of the cap 204, a pair of separation claws 204*a* are provided on a diagonal line of the cap 204. When the separation claw 204*a* moves in a vertical direction between the first position and the second position, it engages with the slider 205 so that the separation claw 204*a* and the slider 205 can regulate the relative position to each other.

On the side face of the slider 205, the first tapered projection 206 and the second tapered projection 208 are provided so as to extend in the primary scanning direction. As shown in FIGS. 8, 10, and 12, each of the first tapered projection 206 and the second tapered projection 208 is tapered in the same direction, engages with the lever 210 as described above, and turns the urging force of the spring 211 and the lever 210 in the vertical direction into the force for urging the slider 205 from the home position side to the away position side in the primary scanning direction.

On the side face of the slider 205, a pair of slider ribs 207 are provided so as to extend in the sheet transporting direction (secondary scanning direction). In this case, the slider ribs 207 are provided so that they come into contact with the slider guide 215*a* that is provided in the base 215 shown in FIGS. 4 and 6. That is, since the slider rib 207 comes into contact with the slider guide 215*a* or is regulated by the slider guide 215*a* by the force for urging the slider 205 to the away position side, the slider 205 at the first position is positioned with high precision in the primary scanning direction.

The slider 205 is provided with the first claws 214*c*, which can come into contact with the upstream side face and the downstream side face of the recording head 106 relative to the sheet transporting direction, and the second claw 214*d*, which can come into contact with the side face of the home position side of the recording head 106 facing the primary scanning direction.

Although the pair of separation claws 204*a* are provided on the diagonal line of the cap 204 as described the above, only one separation claw 204*a* is shown in FIGS. 15A to 17.

Figure 15A:
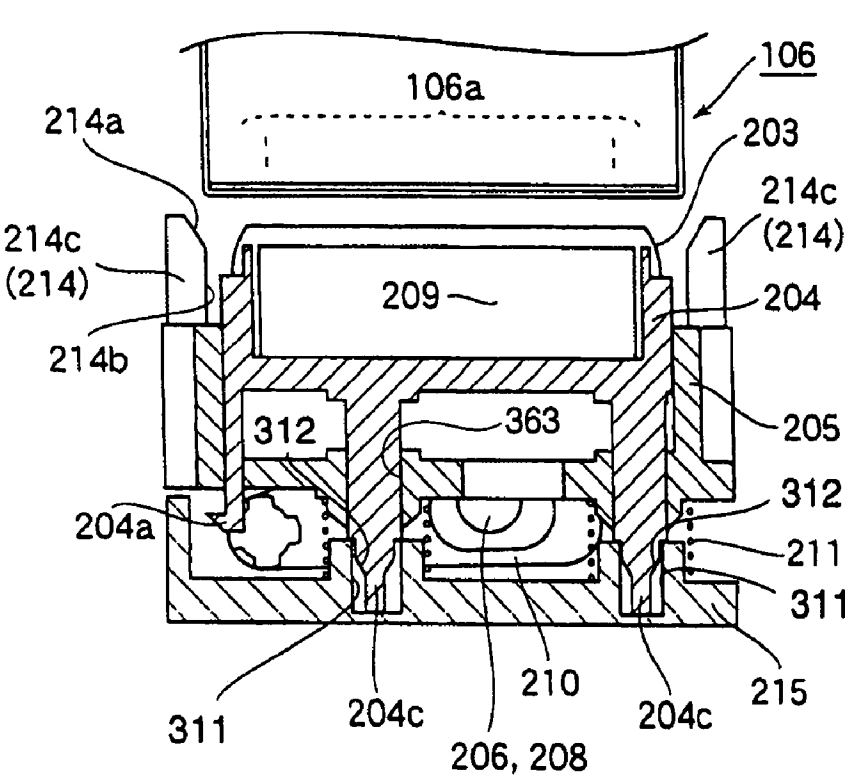

As shown in FIG. 15A, at the first position, the separation claw 204*a* takes no action.

Next, as shown in FIG. 15B, as the lever 210 pivots slightly in the counterclockwise direction in this figure, the slider 205 moves slightly to the recording head side. Incidentally, the cap 204 maintains the first position without movement.

Further, as shown in FIG. 16A, as the lever 210 pivots in the counterclockwise direction in this figure, the slider 205 further moves to the recording head side. Incidentally, first, the first slope faces 214*a* of the pair of first claws 214*c* come into contact with the lower parts of the upstream side face and the downstream side face of the recording head 106 relative to the sheet transporting direction. Then, the lower part of the recording head 106, which comes into contact with the first slope face 214*a*, is guided to the first abutment face 214*b* while going down the first slope face 214*a*. That is, the slider 205 is guided by the first claw 214*c* in the sheet transporting direction with relatively high precision with respect to the recording head 106, and is then positioned. Next, the bottom wall of the slider 205 comes into contact with the bottom face of the cap 204. Accordingly, the leg 204*c* of the cap 204 is spaced apart from the base 215, and the slider 205 is moved to the recording head side together with the cap 204.

As shown in FIG. 16B, as the lever 210 further pivots in the counterclockwise direction in this figure, the cap 204 comes into contact with the recording head 106 so as to seal the nozzle orifice array 106*a*. As described above, while the capping unit 202 moves from the first position to the second position, the separation claw 204*a* takes no action.

However, as shown in FIG. 17, when the capping unit 202 moves from the second position to the first position, due to the ink or pushing force, the cap 204 may adhere to the recording head 106. In this case, first, the lever 210 pivots in the clockwise direction in this figure so that the slider 205 is spaced apart from the recording head 106. That is, the first claw 214*c* and the second claw 214*d* are spaced apart from the recording head 106. Next, the lever 210 further pivots in the clockwise direction in this figure, and the separation claw 204*a* of the cap 204 abuts against the bottom face of the slider 205. That is, if the lever 210 further rotates, the relative position is regulated by the separation claw 204*a*, and the slider 205 and the cap 204 are moved together to the first position. Accordingly, the cap 204 can be separated from the recording head 106.

Further, since the pair of the separation claws 204*a* are provided on the diagonal line of the cap 204, the cap 204 can be surely separated from the recording head 106. That is, it is avoided a case where the separation is not completely made while only a part of the cap 204 still adheres to the recording head 106.

In this embodiment, in the recording apparatus 100 which ejects the ink from the nozzle orifice that serves as the nozzle orifice provided in the recording head 106 and performs the recording on the paper serving as the recording medium, the head capping device 230 according to this embodiment has the capping unit 202 that can move to the first position, which is spaced apart from the recording head 106, and the second position, which seals the nozzle orifice array 106*a* that comes into the recording head 106 and is made of the nozzle orifices, by the spring 211, the cam 213, and the lever 210. The capping unit 202 includes a slider 205 in which the claw 214 that can come into contact with the recording head 106 is formed, and the capping unit 204 that is accommodated in the slider and moves relatively with respect to the slider 205 so as to seal the nozzle orifice array 106*a*. Further, in the slider 205 or the cap 204, the separation claw 204*a*, which regulates the relative position to each other, is provided.

As a result, when moving from the second position to the first position, even though the cap 204 adheres to the recording head 106, since the position of the slider 205 moves, the separation claw 204*a* can serve to move the position of the capping unit 204. Accordingly, even though the capping unit 204 adheres to the recording head 106, the slider 205 can move so as to engage with the separation claw 204*a* so that the cap 204 can be separated from the recording head 106.

In addition, since the cap 204 can relatively move with respect to the slider 205, the cap 204 at the first position can be provided at the position near the recording head 106. That is, at the time of the flushing operation, the cap 204 is already disposed at the position near the nozzle orifice to the extent that it can prevent that the ink ejected from the nozzle orifice becomes floating mist. Therefore, the additional movement for preventing the mist does not need to be made.

Further, the slider 205 at the first position is positioned so that the first claw 214*c* and the second claw 214*d* of the claw 214 are always spaced apart from the recording head 106. Accordingly, when the recording head 106 moves the position opposing the capping unit 204, the recording head 106 does not abut against the first claw 214*c* and the second claw 214*d*. For this reason, the driving speed of the carriage motor 102 does not need to be reduced from the high speed to the low speed near the position opposing the cap 204.

As a result, the time taken for the flushing operation performed at the time of recording can be shortened. In addition, even when the suction operation is performed after the recording operation, since the driving speed of the carriage motor does not need to be reduced, the time taken for the suction operation can be reduced. In addition, since the recording head 106 does not come into contact with the first claw 214*c* and the second claw 214*d*, when the recording head 106 moves to the position opposing the cap 204, the load applied on the carriage motor 102 is not increased. Accordingly, it is possible to downsize the carriage motor 102.

When moving from the first position to the second position, the contact frictional resistance between the claw 214 and the recording head 106 is generated, which results in the load for the cam 213, the lever 210, the sheet transporting motor or the sheet feeding motor 104. In addition, when the cap 204 adheres to the recording head 106, the force by which the cap 204 is separated from the recording head 106 through the separation claw 204*a* becomes the load for the cam 213, the lever 210, the sheet transporting motor or the sheet feeding motor 104. Further, the cap 204 is generally urged to the direction of the recording head 106 by the elastic force of the spring 211. Accordingly, in the cam 213, the lever 210, the sheet transporting motor or the sheet feeding motor 104, the load corresponding to the accumulated force of the contact frictional resistance, the separation force, and the spring force may be generated.

Accordingly, when the separation claw 204*a* of this embodiment moves from the second position to the first position, only the slider 205 starts to move, and when the cap 204 stops at the second position, that is, when the cap 204 adheres to the recording head 106, it is constructed so that it engages with the slider 205 after the first claw 214*c* and the second claw 214*d* of the claw 214 of the slider 205 are spaced apart from the recording head 106.

As a result, at least the frictional resistance and the separation force do not simultaneously become the load for the cam 213, the lever 210, the sheet transporting motor or the sheet feeding motor 104. That is, it is possible to differentiate the timing of the load that is applied to the cam 213, the lever 210, the sheet transporting motor or the sheet feeding motor 104. Therefore, it is possible to reduce the size of the sheet transporting motor or the sheet feeding motor 104.

Here, in the head capping device 230 in which the cap 204 and the slider 205 freely move, as a method of preventing the mist from occurring at the time of the flushing operation, a method of positioning the cap 204 at the first position so as to be adjacent to the recording head 106 is considered. In this case, when moving from the first position to the second position, first, if the cap 204 moves or the cap 204 and the slider 205 move at the same time, the cap 204 may come into contact with or seal the recording head 106.

Accordingly, in the recording apparatus 100 which ejects the ink from the nozzle orifice that serves as the nozzle orifice provided in the recording head 106 and performs the recording on the paper, the head capping device 230 according this embodiment has a capping unit 202 that can move to the first position, which is spaced apart from the recording head 106, and the second position, which seals the nozzle orifice array 106*a* that comes into the recording head 106 and is made of the nozzle orifices, by the spring 211, the cam 213, and the lever 210. The capping unit 202 includes a slider 205 in which the first claw 214*c* and the second claw 214*d* of the claw 214 that can come into contact with the recording head 106 are formed, and the capping unit 204 that moves relatively with respect to the slider 205 and seals the nozzle orifice array 106*a*. When moving from the first position to the second position, first, the slider 205 starts to move, and then the cap 204 moves. In this case, the cap 204 is provided in the slider 205 so that it can move in a vertical direction with respect to the nozzle formation face 106*a*.

As a result, before the cap 204 comes into contact with or seals the recording head 106, the first claw 214*c* and the second claw 214*d* of the claw 214 of the slider 205 come into contact with the recording head 106 so as to guide the cap 204 to the predetermined position with high precision.

For example, when the moving from the first position to the second position, in a case where the slope faces 214*a* and 214*e* are provided at the distal end of the claw 214 and the slider 205 moves in advance, the claw 214 can make the slope faces 214*a* and 214*e* come into contact with the part of the recording head side so that the sliders 205 and the cap 204 can move in the direction parallel to the nozzle formation face 106*b* of the recording head 106. That is, the claw 214 moves the cap 204 to the position opposing the sealed nozzle orifice array 106*a* in the direction parallel to the nozzle formation face 106*b*, and the cap 204 can move to the direction for sealing the nozzle orifice array 106*a* (direction vertical to the nozzle formation face 106*b*).

Further, in this embodiment, the cap 204 starts to move after the first claw 214*c* and the second claw 214*d* of the claw 214 of the slider 205 come into contact with the recording head 106.

As a result, after accurately positioning the cap 204 with the respect to the recording head 106 with high precision by the first claw 214*c* and the second claw 214*d*, the cap 204 moves. As a result, the moving distance of the cap 204 from the first position to the second position, that is, the movable length of the cap 204 can be set to be short. Therefore, in order to prevent the mist from occurring at the time of the flushing operation, the cap 204 can be provided so that the cap at the first position is further adjacent to the recording head 106.

For example, when the moving from the first position to the second position, in a case where after the slope faces 214*a* and 214*e* are provided at the distal end of the claw 214 and the slider 205 moves in advance to come into contact with the recording head 106, the cap 204 moves, the claw 214 can make the cap 204 to the position opposing the nozzle orifice array 106*a* in the direction parallel to the nozzle formation face 106*b*, and the cap 204 can move to the direction for sealing the nozzle orifice array 106*a* (direction vertical to the nozzle formation face 106*b*). That is, it is possible to shorten the moving distance in the sealing direction.

In the recording apparatus 100 which ejects the ink from the nozzle orifice that serves as the nozzle orifice provided in the recording head 406 and performs the recording on the paper, the head capping device 230 according to this embodiment has a capping unit 202 that can move to the first position, which is spaced apart from the recording head 106, and the second position, which seals the nozzle orifice array 106*a* that comes into contact with the recording head 106 and is made of the nozzle orifices, by the spring 211, the cam 213, and the lever 210. The capping unit 202 includes a slider 205 in which the first claw 214*c* and the second claw 214*e* of the claw 214 that can come into contact with the recording head 106 are formed, and the capping unit 204 that is accommodated in the slider 205 and seals the nozzle orifice array 106*a*. In the movement between the first position and the second position, the movable length of the cap 204 is smaller than the movable length of the slider 205, and at the first position, the cap 204 is constructed so that it comes into contact with the base 215 of the head capping device 230 so as to regulate the movement from the second position toward the first position.

In addition, in the head capping device 230 according to this embodiment, when the capping unit 202 moves from the second position to the first position, first, the cap 204 and the slider 205 move together. Next, only the cap 204 is stopped, and then the slider 205 is stopped. In the above-mentioned embodiment, the legs 204*c* come into contact with the base 215, and only the cap 204 is stopped. However, the portions of the cap 204 may not come into contact with the base 215, and the cap 204 may be stopped. For example, the cap 204 may be supported by an urging member, such as a spring, which is provided in the slider.

In the recording apparatus 100 which ejects the ink from the nozzle orifice that serves as the nozzle orifice provided in the recording head 106 and performs the recording on the paper, the capping device 230 according this embodiment has the capping unit 202 that can move to the first position, which is spaced apart from the recording head 106, and the second position, which seals the nozzle orifice array 106*a* that comes into the recording head 106 and is made of the nozzle orifices, by the spring 211, the cam 213, and the lever 210. The capping unit 202 includes the second claw 214*d* that can come into contact with one side face of the recording head 106, the first tapered projection 206 and the second tapered projection 208 that receive the force from the lever 210. The force which the slider 205 receives from the lever 210 when moving between the first position and the second position is applied to the recording head 106 through the second claw 214*d*, and the second claw 214*d* is constructed so as to guide the capping unit 202.

As a result, when the suction operation is performed, since the second claw 214*d* comes into contact with the recording head 106 without the clearance so as to guide the capping unit 202 to the second position, the relative positional relationship between the capping unit 202 and the recording head 106 at the second position can be determined with high precision in the direction where the force which the slider 205 receives from the lever 210 is applied (the force for urging the slider 205 to the away position side in the primary scanning direction).

For example, when the moving from the first position to the second position, in a case where the direction that the force applied from the actuator 210 is directed from the home position side to the away position side of the primary scanning direction, the claw 214*d* located in the home position side can move closely and come into contact with the one side face of the recording head 106 located in the away position side to as to guide the capping unit 202 to the second position. On the other hand, in a case where the one side face of the recording head 106 is located in the home position side and the abutment face 214*f* of the claw 214*d* is located in the away position side, the slope face 214*e* is provided at the front end of the claw 214*d*, the slope face 214*e* comes into contact with a portion of the recording head side, and the capping unit 202 can be guided to the second position. That is, the slope face 214*e* comes into contact with the portion of the recording head side, and can move the capping unit 202 and the claw 214*d* to the home position side while being against the force from the actuator 210. Accordingly, the abutment face 214*f* of the claw 214*d* can move to the home position side more than the one side face of the recording head 106. As a result, similar to the above-mentioned description, the claw 214*d* of the home position side can move closely and come into contact with the one side face of the recording head 106 located in the away position side to as to guide the capping unit 202 to the second position.

In addition, since the second claw 214*d* can come into contact with the one side face of the recording head 106 to as to guide the capping unit 202 to the second position, in the direction where the force which the slider 205 receives from the lever 210 is applied (the force for urging the slider 205 to the away position side), the second claw 214*d* may be provided on only one side, and an additional claw does not need to be provided at the position opposing the second claw 214*d*.

In addition, in the capping device 230 according to this embodiment, the slider rib 207 is provided in the capping unit side, and the slider rib 207 is constructed such that it comes into contact with the slider guide 215*a* at the first position. In this case, the slider guide 215*a* that is provided in the base 215 by the force which the slider 205 receives from the lever 210 (the force for urging the slider 205 to the away position side).

As a result, in a direction where the force which the slider 205 receives from the lever 210 (the force for urging the slider 205 to the away position side) is applied, the capping unit 202 at the first position can positioned with high precision with respect to the base 215. For example, at the time of the flushing operation, the recording head 106 moves to the position opposing the capping unit 202 so as to eject ink. At this time, since the capping unit 202 is disposed at the first position with high precision, the ink ejected from the recording head 106 can be surely received by the capping unit 202 without being floating mist.

Further, the capping device 230 according to this embodiment includes a motive power releaser 231 allows the lever 210 not to apply the power with respect to the first tapered projection 206 and the second tapered projection 208 when the capping unit 202 is placed in the second position.

That is, in a state in which the capping unit 202 comes into contact with the recording head 106 and seals the nozzle orifice array 106*a*, the extra force (the force for urging the slider 205 to the away position side) is not applied to the capping unit 202, it is possible to surely seal the nozzle orifice array 106*a*. Accordingly, the inside of the capping unit 202 can be decompressed so as to perform excellent suction operation.

In this embodiment, the first tapered projection 206 and the second tapered projection 208 converts the spring force of the spring 211, which is the force for urging the capping unit 202 from the first position to the second position, into the force which the slider 205 receives from the lever 210 (the force for urging the slider 205 to the away position side).

As a result, the direction of the elastic force of the spring 211 is converted into another direction by the tapered portions (the first tapered projection 206 and the second tapered projection 208) so as to become the force which the slider 205 receives the lever 210 (the force for urging the slider 205 to the away position side).

The carriage 107, which has the recording head 106, is reciprocally driven in the primary scanning direction by the carriage motor 102 while being guided to the carriage guide shaft that extends in the primary scanning direction as described above. Accordingly, when the carriage 107 moves to the position opposing the capping unit 202 so as to stop, in the variation in the stop position of the carriage 107, it is apparent that the variation in the primary scanning direction is larger than the variation in the secondary scanning direction (sheet transporting direction).

Accordingly, in this embodiment, the direction where the force that the slider 205 receives from the lever 210 (the force for urging the slider 205 to the away position side) is applied becomes the primary scanning direction.

As a result, in the primary scanning direction, the relative positional relationship between the capping unit 202 and the recording head 106 at the second position can be determined with high precision. That is, when the capping unit 202 moves to the second position, even though the variation in the stop position of the recording head 106 in the primary scanning direction is large, the capping unit 202 can be positioned relatively with respect to the recording head 106 which should follow the variation in the primary scanning direction.

The second claw 214*d* according to this embodiment has the second slope face 214*e* and the second abutment face 214*f* continued from the second slope face 214*e*, which are provided at the distal end thereof.

As a result, when the capping unit 202 moves between the first position and the second position, the second slope face 214*e* comes into contact with the recording head 106 so as to guide the capping unit 202. For example, when moving from the first position to the second position, in a case where one side face of the recording head 106 is located in the home position side and the abutment face of the claw 214*d* is located in the away position side, the slope face 214*e* comes into contact with the portion of the recording head side, and thus it can guide the capping unit 202 to the second position while being against the force from the actuator 210. At this time, if the slope face 214*e* is elongated in a direction where the force is applied from the actuator 210, it can follow the variation in the position of the recording head 106 within the elongated range.

In addition, since the second claw 214*d* has the second abutment face 214*f* continued from the second slope face 214*e*, when the capping unit 202 moves between the first position and the second position, it can reduce the area contacting the recording head 106. That is, it is possible to reduce the frictional resistance when by the second abutment face 214*f*, the capping unit 202 is guided to move.

In this embodiment the tapered faces are provided as the first tapered projection 206 and the second tapered projection 208. However, the tapered faces (slope faces) may be provided on the openings 210*d* of the lever 210.

Next, a second embodiment of the invention will be described. Components similar to those in the first embodiment will be designated by the same reference numerals and repetitive explanations for those will be omitted.

Figure 18:
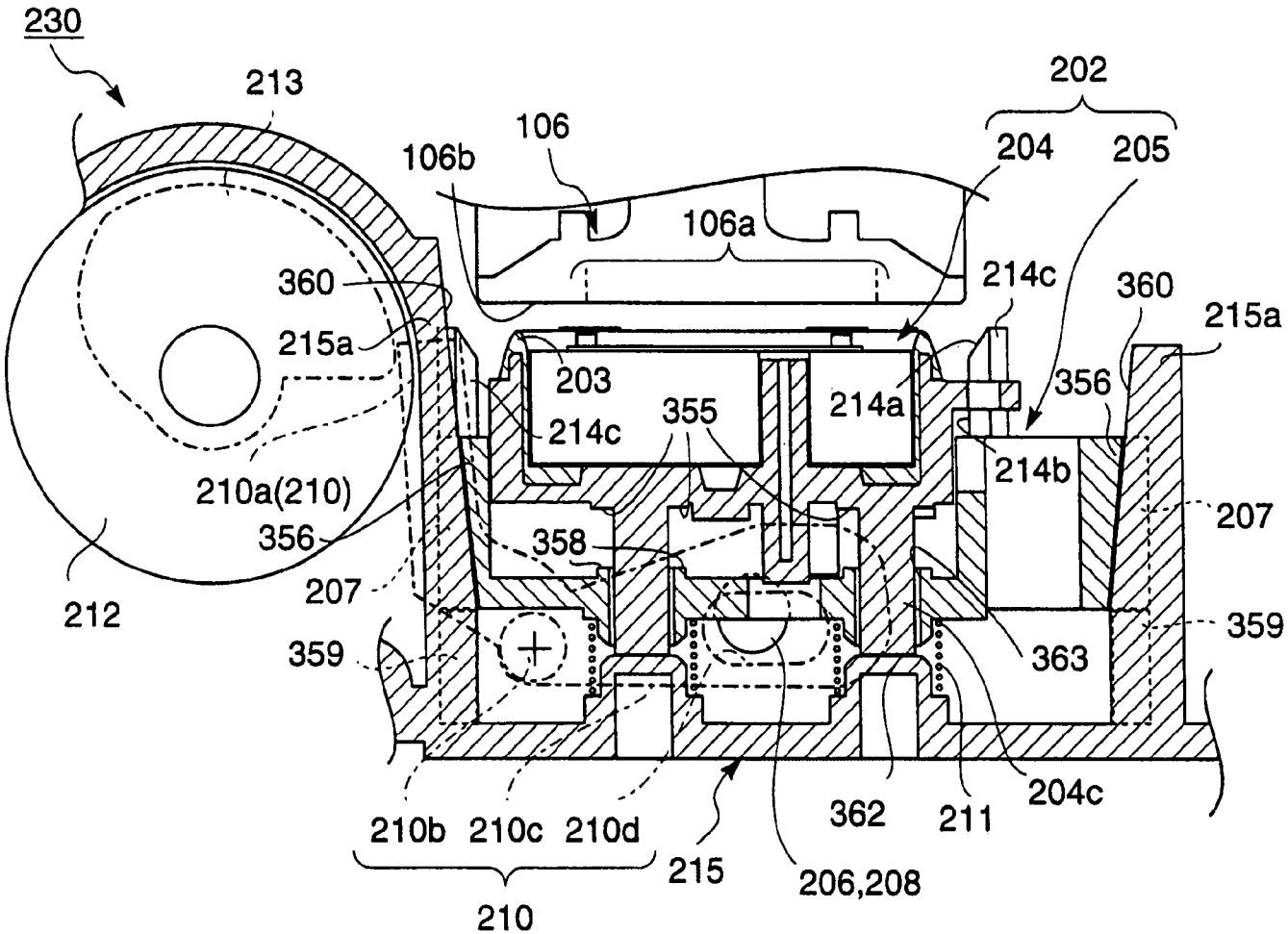
FIG. 18 is a section view of a head capping device according to a second embodiment of the invention, viewed from the primary scanning direction and showing a state that a capping unit is placed in the first position thereof.
Figure 19:
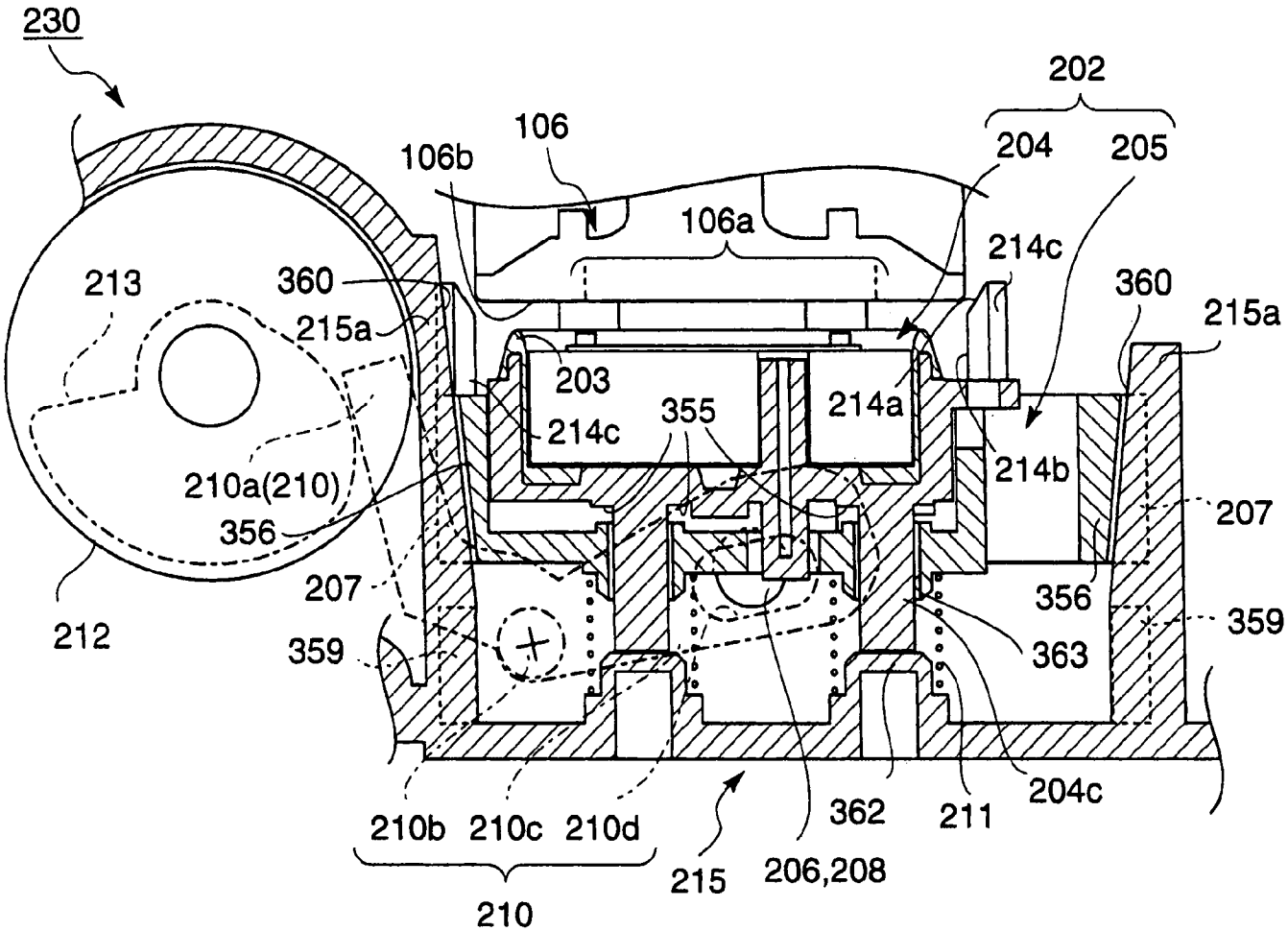
FIG. 19 is a section view of the head capping device of FIG. 18, viewed from the primary scanning direction and showing a state that the capping unit is moved from the first position to the second position thereof.
Figure 20:
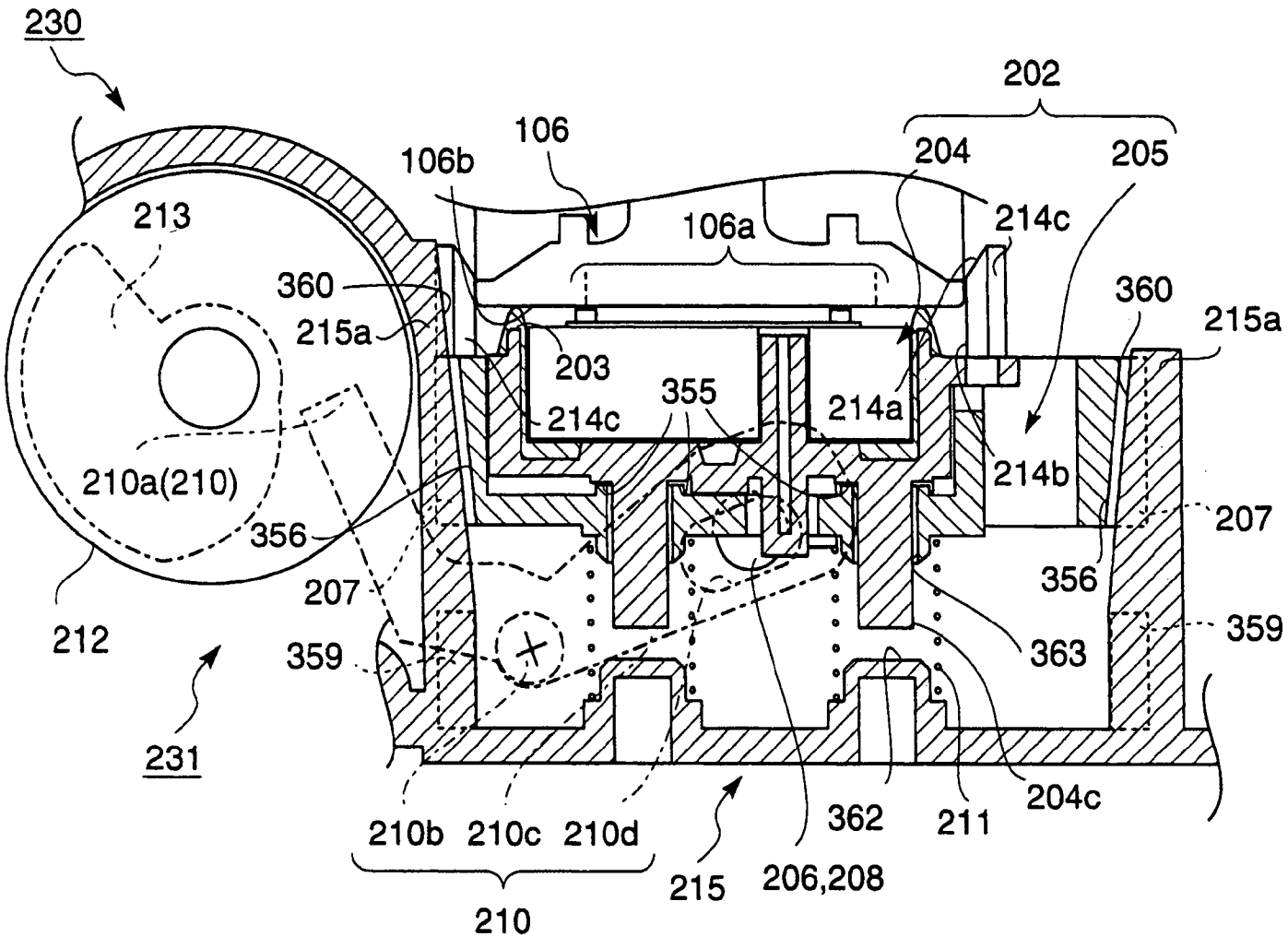
FIG. 20 is a section view of the head capping device of FIG. 18, viewed from the primary scanning direction and showing a state that the capping unit is placed in the second position.

In this embodiment, as shown in FIGS. 18 to 20, at the first position of the capping unit 202, the legs 204*c* come into contact with base protrusions 362 that are provided on the base 215. Accordingly, the position of the cap 204 in the heightwise direction can be determined with high precision at the first position. That is, at the time of the flushing operation, the distance between the cap 204 and the recording head 106 can be set to the extent that the mist is not generated, but the cap 204 and the recording head 106 do not come into contact with each other.

A pair of tapered faces 356 is formed on the outer faces of the slider 205 in the secondary scanning direction. On the other hand, a pair of slope faces 360 is formed on the slider guides 215*a*. Specifically, the slope faces 360 are provided so that the distance between the tapered faces 356 and the slider guides 215*a* is gradually decreased downward.

A rib 355 is provided on a proximal end of each of the legs 204*c*, and a rib receiving member 358 is provided near each of the leg receiving holes 311.

As the slider 205 moves upward from the first position of the capping unit 202 shown in FIG. 18 to the position shown in FIG. 19 and to the second position shown in FIG. 20, the clearance is generated between the tapered faces 356 and the slope faces 360. Accordingly, as the slider 205 and the cap 204 move upward, they are released from the regulation of the base 215 in the sheet transporting direction. In addition, the slider 205 and the cap 204 are guided to the first claws 214*c* and the second claws 214*d* and positioned with relatively high precision with respect to the recording head 106.

Here, as the slider 205 is pushed down from the second position of the capping unit 202 shown in FIG. 20 to the position shown in FIG. 19 and to the first position shown in FIG. 18, the tapered faces 356 come into contact with the slope faces 360. Accordingly, at the first position, the slider 205 can be positioned with high precision with respect to the base 215 in the sheet transporting direction.

Figure 21:
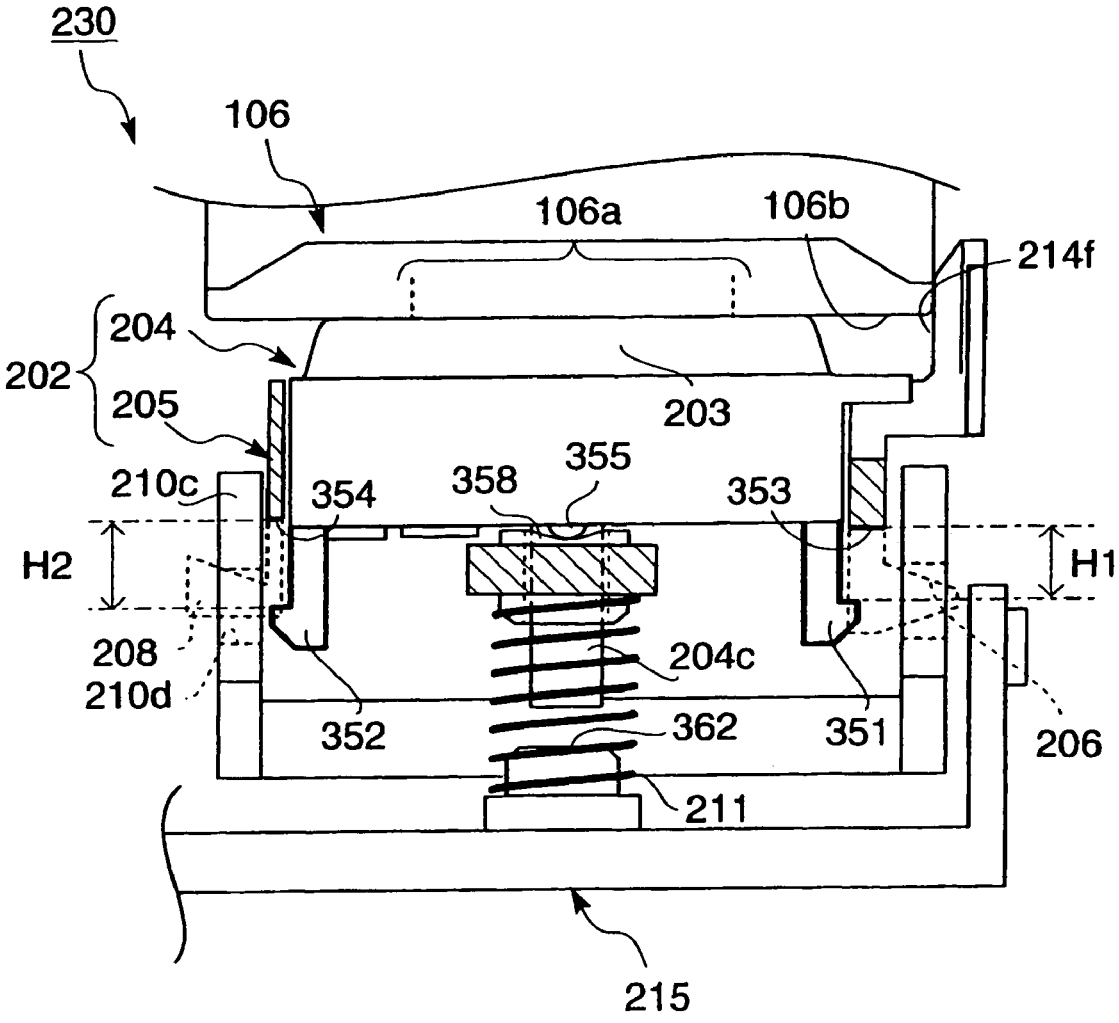
FIGS. 21 to 23 are section views of a head capping device according to a third embodiment of the invention, viewed from the secondary scanning direction and showing a state that a capping unit is moved from the second position to the first position.

In addition, when moving from the first position to the second position, the ribs 355 is engaged with the rib receiving member 358 (cf., FIG. 21). Accordingly, the cap 204 can rock with respect to the slider 205 in the primary scanning direction owing to the curved face of the rib receiving member 358. As a result, when moving from the first position to the second position, even though the slider 205 is urged to the away position side of the primary scanning direction, the frictional resistance is generated between the second claw 214*d* and the recording head 106, and the slider 205 is inclined with respect to the recording head 106 in the primary scanning direction, thereby maintaining its posture positively, and surely coming into contact with recording head 106. As a result, the cap 204 can surely seal the nozzle orifice array 106*a*.

Moreover, at the second position, the position of the cap 204 with respect to the slider 205 in the primary scanning direction can be determined with high precision. Incidentally, as described above, the relative positional relationship between the slider 205 and the recording head 106 can be determined with high precision by the second claw 214*d*. Accordingly, in the primary scanning direction, the relative position of the cap 204 with respect to the recording head 106 can be determined with high precision.

In this embodiment, the ribs 355 are provided on the cap 204, and the rib receiving members 358 are provided on the slider 205. However, the rib receiving member may be provided on the cap 204, and the ribs may be provided on the slider 205.

Next, a third embodiment of the invention will be described. Components similar to those in the second embodiment will be designated by the same reference numerals and repetitive explanations for those will be omitted.

In this embodiment, as shown in FIG. 21, a first separation claw 351 and a second separation claw 352 are provided on the diagonal line of the sealing surface of the cap 204. Here, the "sealing surface" refers to a surface formed by a contacting position when the abutment face 203 comes into contact with the nozzle formation face 106*b*.

In the slider 205, at the positions where the first separation claw 351 and the second separation claw 352 of the cap 204 come into contact with, a first regulator 353 and a second regulator 354 are provided. The first separation claw 351, the second separation claw 352, the first regulator 353, and the second regulator 354 are provided so that they regulate the relative position between the slider 205 and the cap 204. The distance H1 between the first separation claw 351 and the first regulator 353 is smaller than the distance H2 between the second separation claw 352 and the second regulator 354.

Figure 22:
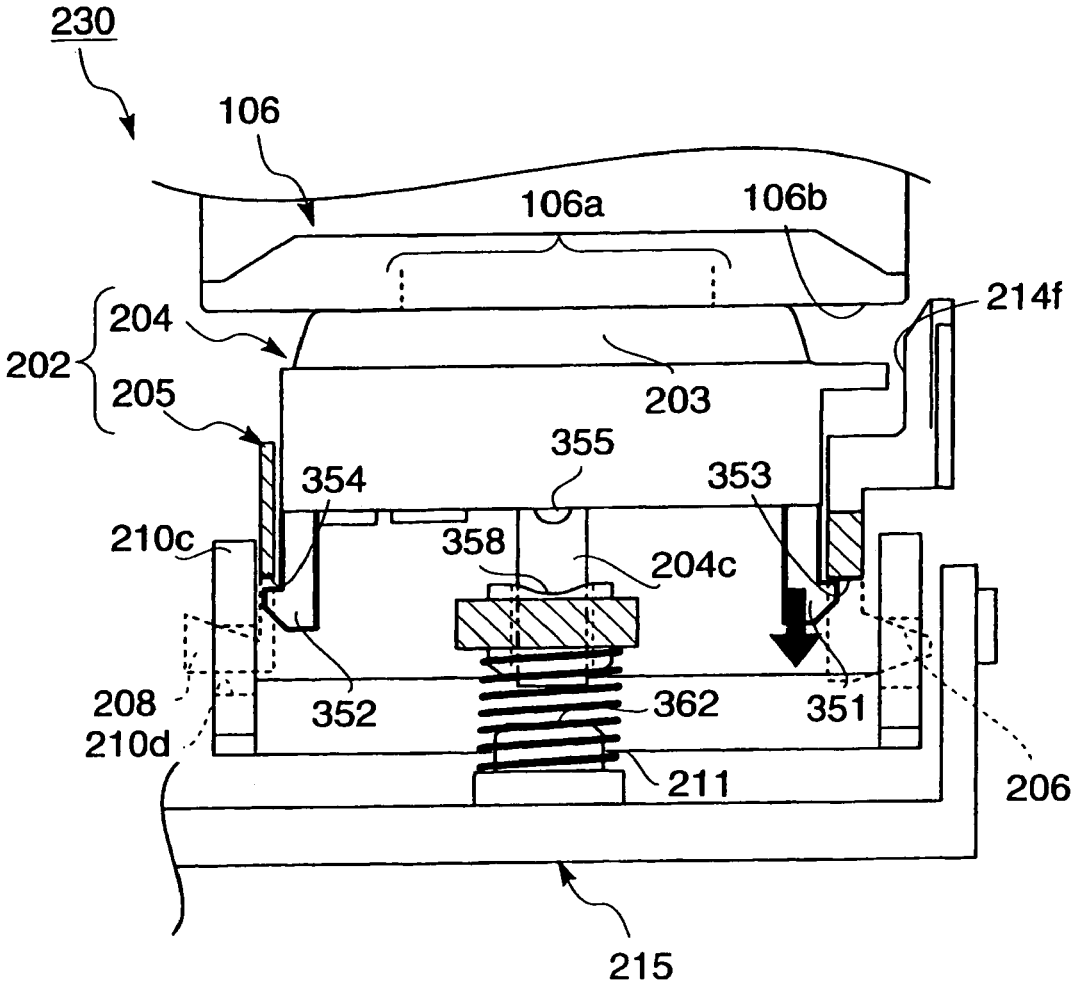

As shown in FIG. 22, even when the lever 210 pivots from the state shown in FIG. 21 so that the slider 205 is gradually pushed down, the cap 204 may adhere to the nozzle formation face 106*b* of the recording head 106 due to the urging force of the two springs 211 and the solidification of the ink. In this case, when the slider 205 moves downward, the first claws 214*c* and the second claws 214*d* are spaced apart from the recording head 106. Then, since the first separation claw 351 and the first regulator 353 first come into contact with each other, the force for pushing down the cap 204 is generated at the home position side of the primary scanning direction and the upstream side of the sheet transporting direction.

Figure 23:
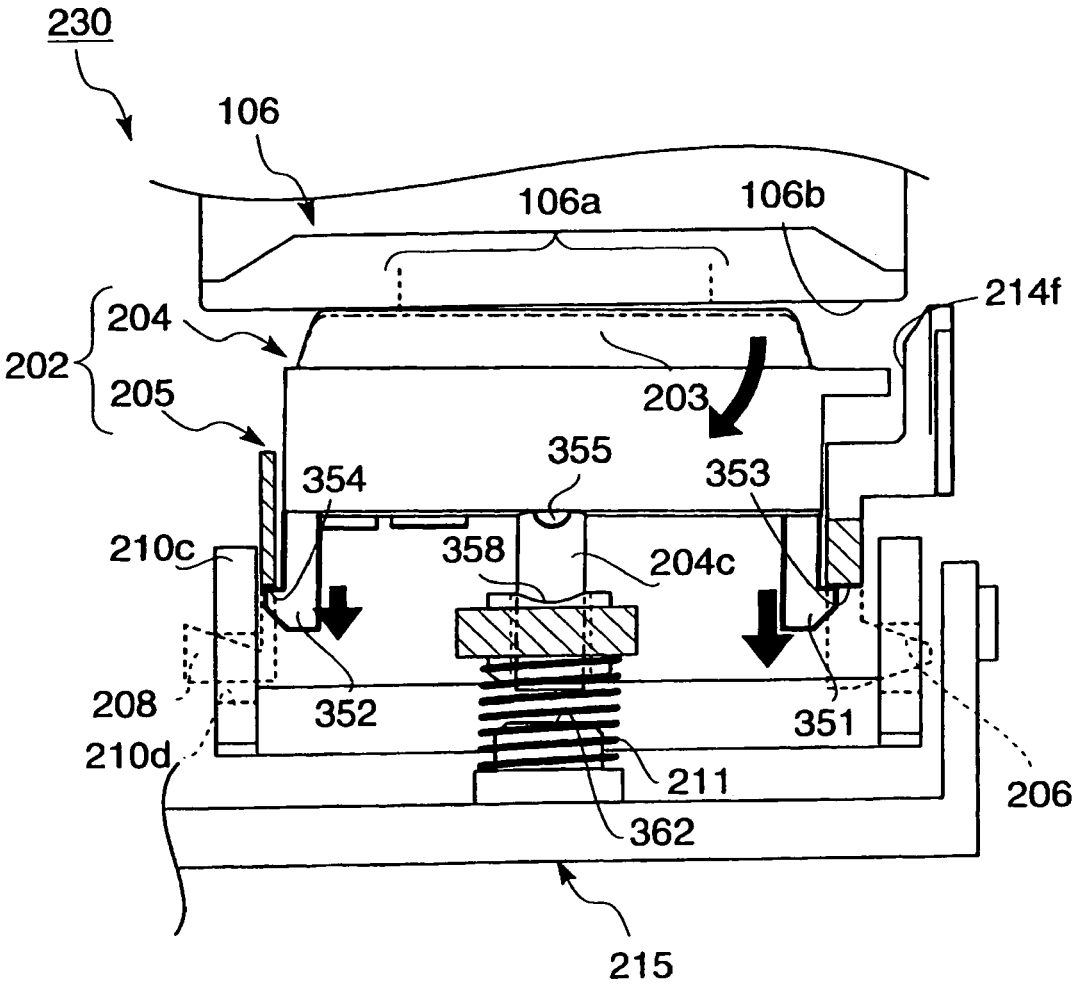

Next, as shown in FIG. 23, as the lever 210 further pushes down the slider 205, since the second separation claw 352 and the second regulator 354 come into contact with each other due to the time difference obtained by the difference between the distance H1 and the distance H2, the force for pushing down the cap 204 is generated at the away position side of the primary scanning direction of the contact position and the downstream side of the sheet transporting direction. That is, the cap 204 that has adhered to the nozzle formation face 106*b* can be gradually separated form the nozzle formation face 106*b* from the position that the first separation claw 351 and the first regulator 353 are provided toward the position that the second separation claw 352 and the second regulator 354 are provided.

Incidentally, the time difference obtained by the difference between the distance H1 and the distance H2 is set, such that the cap 204 having been adhered to the nozzle forming opening surface 106*b* is not separated at one time, but is gradually separated from the edge portion of the cap 204. As compared with a case where the cap is separated at one time, it is possible to peels off the cap 204 from the nozzle formation face 106*b* by the weak force.

In addition, since the cap 204 is gradually separated from the edge portion of the cap 204, it is possible to avoid splashing of the ink when the cap is separated, as compared with the case where the cap is separated at one time.

In this embodiment, two separation claws 351 and 352 and two regulators 353 and 354 are provided. However, three or more separation claws and regulators may be provided.

In this embodiment, the home position side of the primary scanning direction becomes the relatively short distance H1. That is, the side of the cap 204 opposite to the side where the paper is transported is separated from the nozzle formation face 106*b*. Accordingly, even though ink is splashed when the cap 204 is separated from the nozzle formation face 106*b*, such splashed ink can be prevented from splashing to the side where the paper is transported. As a result, even though the ink is splashed when the cap is separated, the splashed ink will not contaminate the paper and the sheet transporting path.

In addition, a ink-ink shielding wall may be provided between the two second claws 214*d* of the slider 205. In this case, even when the ink splashes to the home position side of the primary scanning direction, it is possible to prevent the splashed ink from contaminate the circumference.

In this embodiment, the first separation claw 351 and the first regulator 353 are provided on the edge portion of the cap 204 that is spaced apart from the center of the cap 204. Here, the "edge portion" refers to the outline of the abutment face 203, including the sides and the corners.

Further, the second separation claw 352 and the second regulator 354 are provided at the corner portion sides opposite to the corner portions, where the first separation claw 351 and the regulator 353. Here, the "corner portion" refers to a portion on or near the corner.

Next, a fourth embodiment of the invention will be described. Components similar to those in the first embodiment will be designated by the same reference numerals and repetitive explanations for those will be omitted.

Figure 24:
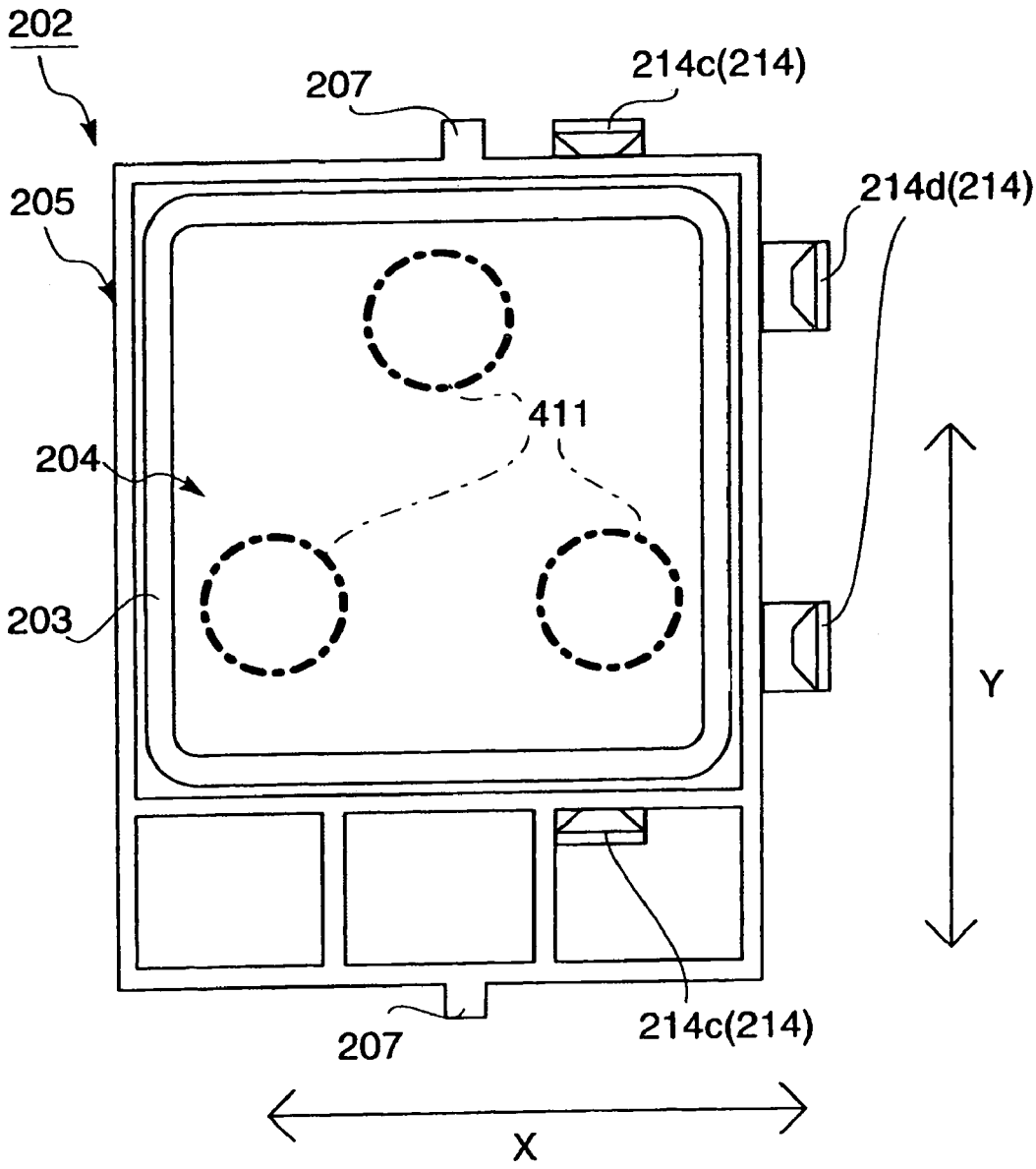
FIG. 24 is a top plan view of a head capping device according to a fourth embodiment of the invention.
Figure 25:
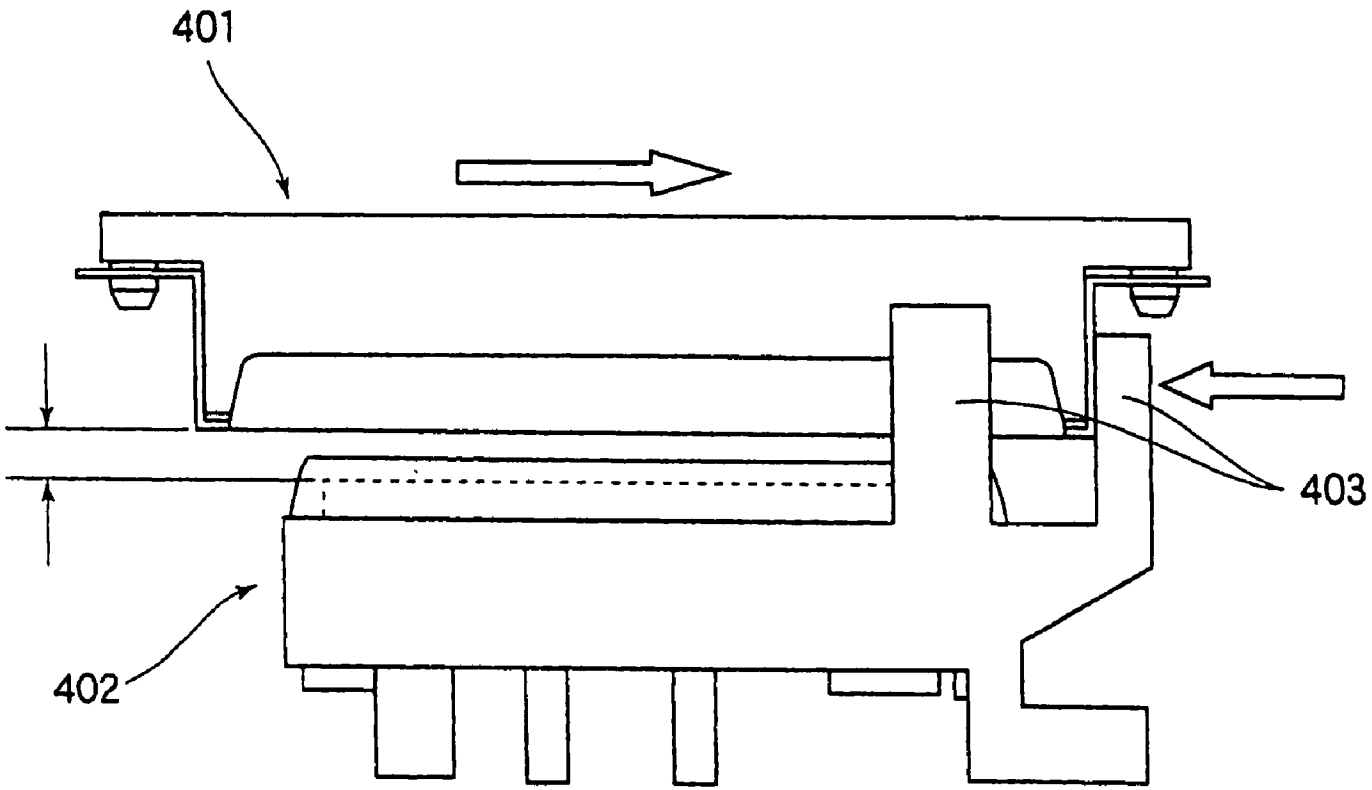
FIG. 25 is a schematic side view showing a related-art head capping device.

In this embodiment, as shown in FIG. 24, there are provided three springs 411 between the base 215 and the slider 205. These three springs 411 are arranged such that a plurality of springs are arranged when viewed from both of the primary scanning direction X and the secondary scanning direction Y. That is, the three springs 411 are not aligned in either the primary scanning direction X or the secondary scanning direction Y. When the capping unit 202 moves to the second position, the first claws 214*c* and the second claws 214*d* that are provided in the slider 205 comes into contact with the recording head 106. Since the frictional force is generated, the posture of the slider 205 with respect to the nozzle formation face 106*b* becomes unstable. Even in this case, the posture of the slider 205 with respect to the nozzle formation face 106*b* can be stabilized by the urging force of the springs 411 that are arranged as described the above. Accordingly, the posture of the cap 204 that is disposed in the slider 205 can be parallel to the nozzle formation face 106*b*. As a result, the abutment face 203 of the cap 204 can come into contact with the nozzle formation face 106*b* of the recording head 106 without the clearance.

Although the present invention has been shown and described with reference to specific preferred embodiments, various changes and modifications will be apparent to those skilled in the art from the teachings herein. Such changes and modifications as are obvious are deemed to come within the spirit, scope and contemplation of the invention as defined in the appended claims.

What is claimed is:

1. A head capping device, adapted to seal a nozzle formation face of a liquid ejecting head in which a nozzle orifice from which liquid is ejected is formed, the device comprising:

a base;

a capping unit, comprising:

a cap, adapted to be abutted against the nozzle formation face to seal the nozzle orifice;

a regulator, provided on the cap;

a slider, mounting the cap; and a claw, provided on the slider and adapted to be abutted against the liquid ejecting head; and an actuator, operable to move the capping unit in between a first position at which the cap is separated away from the nozzle formation face and a second position at which the cap is abutted against the nozzle formation face, wherein:

the slider is so configured as to have a first movable length during the movement between the first position and the second position;

the cap is so configured as to have a second movable length which is smaller than the first movable length, during the movement between the first position and the second position; and the regulator is so configured as to be abutted against the base to restrict the movement of the cap in a direction separating away from the liquid ejecting head when the capping unit is moved from the second position to the first position.

2. The head capping device as set forth in claim 1, wherein:

the cap has a first side adapted to oppose the liquid ejecting head, and a second side opposite to the first side; and the regulator includes a leg provided in the second side of the cap.

3. The head capping device as set forth in claim 2, wherein the capping unit is configured such that, when the capping unit is moved from the second position to the first position, the cap and the slider are first moved together, the leg is then abutted against the base so that only the cap is stopped, and the slider is finally stopped.

4. The head capping device as set forth in claim 2, wherein:

the base comprises an engagement member adapted to be engaged with the leg when the capping unit is placed in the first position; and at least one of the leg and the engagement member is formed with a tapered outer face.

5. The head capping device as set forth in claim 1, further comprising an urging member, disposed between the base and the slider and urging the slider toward the second position, wherein the capping unit is configured such that, when the capping unit is moved from the second position to the first position, the slider and the cap are moved together after the slider is abutted against the cap.

6. A liquid ejecting apparatus, comprising:

a liquid ejecting head, having a nozzle formation face formed with a nozzle orifice, and adapted to eject liquid from the nozzle orifice toward a target medium; and the head capping device as set forth in claim 1.

* * * * *